US010249142B2

(12) United States Patent
Schmidt et al.

(10) Patent No.: US 10,249,142 B2
(45) **Date of Patent: *Apr. 2, 2019**

(54) APPARATUS AND METHOD FOR A GAME WITH SYMBOL ARRAY OF VARYING SIZE

(71) Applicant: Novomatic AG, Gumpoldskirchen (AT)

(72) Inventors: Heike Schmidt, Vienna (AT); Daniel Huppert, Gumpoldskirchen (AT)

(73) Assignee: Novomatic AG, Gumpoldskirchen (AT)

( * ) Notice: Subject to any disclaimer, the term of this patent is extended or adjusted under 35 U.S.C. 154(b) by 0 days.

This patent is subject to a terminal disclaimer.

(21) Appl. No.: 15/720,268

(22) Filed: Sep. 29, 2017

(65) Prior Publication Data

US 2018/0025585 A1 Jan. 25, 2018

Related U.S. Application Data

(63) Continuation-in-part of application No. 14/989,001, filed on Jan. 6, 2016, now Pat. No. 9,805,557.

(51) Int. Cl.
*G07F 17/32* (2006.01)
*G07F 17/34* (2006.01)

(52) U.S. Cl.
CPC ..... *G07F 17/3269* (2013.01); *G07F 17/3209* (2013.01); *G07F 17/3211* (2013.01); *G07F 17/3262* (2013.01); *G07F 17/3267* (2013.01); *G07F 17/3288* (2013.01); *G07F 17/34* (2013.01)

(58) Field of Classification Search
None
See application file for complete search history.

(56) References Cited

U.S. PATENT DOCUMENTS

| | | | | |
|---|---|---|---|---|
| 6,375,570 | B1 | 4/2002 | Poole | |
| 9,747,755 | B2 * | 8/2017 | Kroon | G07F 17/34 |
| 2011/0201406 | A1 | 8/2011 | Jaffe | |
| 2013/0331173 | A1 * | 12/2013 | Jaffe | G07F 17/3267 463/21 |
| 2014/0031100 | A1 * | 1/2014 | Gomez | G07F 17/3265 463/20 |
| 2016/0314661 | A1 | 10/2016 | Vann | |
| 2017/0092043 | A1 | 3/2017 | Shiraishi | |
| 2017/0092073 | A1 | 3/2017 | Nakamura | |

OTHER PUBLICATIONS

Notice of Allowance for U.S. Appl. No. 14/989,001 dated May 26, 2017; 8 pps.

* cited by examiner

*Primary Examiner* — Ronald Laneau
(74) *Attorney, Agent, or Firm* — Fincham Downs LLC; Magdalena M. Fincham, Esq.

(57) ABSTRACT

In accordance with some embodiments, an electronic gaming machine and method for a game of play is provided for use in a gaming establishment, or on a general purpose computing device for offering games with multiple outcomes. The outcome of game play is displayed as a symbol array on a display device. The size of the symbol array may be varied dynamically (expanded or contracted) from one game play to another by adding or removing at least one symbol position once a trigger event has been detected.

23 Claims, 20 Drawing Sheets

APPARATUS AND METHOD FOR A GAME WITH SYMBOL ARRAY OF VARYING SIZE

CLAIM OF PRIORITY

The present application is a Continuation-In-Part of U.S. application Ser. No. 14/989,001, filed Jan. 6, 2016 in the name of Schmidt et al. and titled APPARATUS AND METHOD FOR A GAME WITH EXPANDING SYMBOL MATRIX. The entirety of this application is incorporated by reference herein for all purposes.

COPYRIGHT NOTICE

Portions of this disclosure contain material in which copyright is claimed by the applicant. The applicant has no objection to the copying of this material in the course of making copies of the application file or any patents that may issue on the application, but all other rights whatsoever in the copyrighted material are reserved.

FIELD

At least some embodiments described herein relate generally to gaming machines and methods through which players may initiate game plays and participate in electronic games (e.g., wagering games). More particularly, some embodiments relate to methods for conducting game plays using a symbol array, where the number of symbol positions of the symbol array is dynamically expanded or contracted.

BACKGROUND

In the gaming industry (e.g., wagering game industry and online game industry), gaming machines, especially electronic gaming machines, such as slot machines, video poker machines and the like, have been an important basis for revenues. Gaming providers offer a variety of games such as slot-style games, video poker games, roulette games and many other types of wagering games and other types of electronic games. In some embodiments, electronic games are deployed on electronic gaming machines ("EGMs") at a casino or other gaming establishment for use by players, but they may also be deployed on server-based gaming systems or on a general purpose computing devices or mobile phones in stand-alone form or as online games (e.g., as a video game that is either partially or primarily played across a network such as the Internet or another computer network). Playing such a game (e.g. slot-style game, video poker game, roulette game, etc.) may, in some embodiments, placing a wager on the outcome of the game. In other embodiments, the game may be played without wagering. In some embodiments, games are programmed with a predefined set of outcomes including one or more winning outcomes and one or more losing outcomes. In some types of games, a player may be awarded for a winning outcome and receive no award for a losing outcome.

A win or successful outcome (whether it results in an award to the player, monetary or otherwise, or not) on a slot-style game usually involves matching symbols, either on mechanical reels that spin and stop to reveal one or several symbols, or on simulated reels shown on a display device (e.g. video screen, etc.). The reels, once rotated and stopped—either mechanical or simulated—form a symbol array comprising a plurality of symbol positions, such that a respective symbol is placed or positioned within a given symbol position of the array. In some embodiments, a symbol array comprises a predetermined number of rows and columns. In some embodiments, the number of columns may correspond to the number of reels such that the symbol array forms a rectangular or square-shaped area. In other embodiments, a symbol array may form a non-rectangular or non-traditional shape (e.g., a circle or a pyramid). Many games have a variety of winning combinations of symbols, often posted on the face of the gaming machine. In some games, the outcome of game play is randomly determined—in some implementations via the use of a random number generator and by a processor or control unit. Then, the outcome is displayed in the form of a symbol array, wherein the symbols are randomly selected at each position in the symbol array, and if a winning combination results within the symbol array according to the rules of the game, in some embodiments the player may be provided with an award (e.g. credit, points, cash, extra games, coupons, advancements in the game, etc.).

Generally, the popularity of games depends on the player's expectation of achieving a winning outcome, and on the entertainment value of a particular game compared to other available gaming options. If there are different games available and the expectation of winning at each game is roughly the same, players will be attracted to the most exciting and entertaining games. That being the case, there is a continuing need for new and exciting games, or new types of games in the gaming industry which will attract frequent game play by enhancing the entertainment value and the excitement associated with the game.

Various games use methods of expanding the symbol array by e.g. adding columns (reels) or rows to increase game variation and player excitement. One example of such a game is disclosed in US 2005/0159208 A1 to Pacey. Pacey discloses an EGM using an expandable symbol array to create a series of sequentially larger symbol arrays with the potential of additional or enhanced awards. The expanded symbol array is created by addition of one or more reels to the base array. The expanded symbol array may be generated only under special circumstances that occur in the base symbol array. In response to the occurrence of these circumstances, at least an additional reel is added to the base symbol array producing a larger symbol array.

US 2013/0065663 A1 to Johnson et al., discloses a slot machine game with expanding positions. The slot machine game of Johnson increases the size of the symbol array as a mystery feature. As the reels are spinning, the number of positions available on each reel grows randomly to allow more paylines. The symbol array is expanded using a mystery feature that adds one or more rows to the symbol array.

Although many existing games entertain and excite players, there is always a need for better and more interesting games and features which provide the players with an ever-increasing level of excitement. Such added excitement may be provided by a dynamic variation of the size of the symbol array and, in some embodiments, a resulting varied number of paylines in different game plays.

SUMMARY OF EXAMPLE EMBODIMENTS

Embodiments described herein provide for various apparatus, systems, articles of manufacture and methods that add excitement and a new, innovative form of entertainment to the play of games (e.g., wagering games playable on EGMs). In accordance with some embodiments, highly entertaining game features are provided that thrill the player, and which may be implemented in a base game and/or a bonus game. In accordance with embodiments in which the game is a wagering game, game play may be initiated when the player places an initial wager to play. In embodiments implemented on an EGM or otherwise utilizing a random number generator ("RNG"), after a game play is initiated via an input device, a control unit—in some embodiments using or working with a random number generator ("RNG")—generates an outcome. That outcome is displayed on the display of the EGM to the player. Usually, the outcome is displayed in the form of a symbol array as described herein. Embodiments described herein may be implemented in a base game, a sub-game, a bonus or a free game after detecting a trigger event (e.g. during the process of the current game play or in the outcome of the game play).

According to some embodiments, the game features described herein (which involve a symbol array of varying size), a gaming device (e.g., an EGM) at least includes a display device for displaying game plays including game outcomes, an input device configured to receive input from a player to initiate game plays and a control unit in operative communication with the display device and the input device. The control unit also controls game play to provide a plurality of symbols which are positioned in a symbol array (e.g., a symbol array comprised of a number of rows and columns, wherein the columns may represent the reels). The control unit is configured to initiate a game play in response to an input entered via the input device by a player and to determine randomly, or by using an RNG, an outcome of the game play. The control unit is further configured to direct the display device to display the outcome of the game play in the symbol array, wherein the symbols are randomly arranged (e.g., in accordance with the outcome determined by the RNG) within the symbol array.

In accordance with some embodiments, in response to a trigger event being detected by the control unit, the control unit is further configured to randomly define a defined range, area or other indication of symbol positions or number of symbol positions (collectively referred to herein as "range") for array expansion or contraction of the symbol array (a resizing of the symbol array, whether the type of resizing is an expansion or a contraction of the symbol array). The term array expansion indicates that the symbol array has been enlarged as compared to a previous size or area, such that it includes a greater number of symbol positions for outcomes of the game. The term array contraction indicates that the symbol array has been reduced or made smaller as compared to a previous size or area of the symbol array, such that it includes a smaller number of symbol positions for outcomes of the game. The respective range may be defined by the RNG (or another algorithm, hardware and/or software configuration for performing this function) which selects the respective range (e.g., from a plurality of predetermined available ranges for symbol array expansion or symbol array contraction). In accordance with some embodiments, the selected range may be defined as symbol positions lying or occurring within predetermined maximum limits for symbol array expansion or contraction. The control unit is further configured to create an expanded symbol array or a contracted symbol array, depending on whether the embodiment being implemented is an expansion or a contraction of the symbol array. The expanded or contracted symbol array may be (i) a combination of the symbol array and a maximum possible array expansion (in embodiments in which the symbol array is being expanded responsive to the trigger event); or (ii) the symbol array minus the symbol positions as defined by the maximum possible array contraction (in embodiments in which the symbol array is being contracted responsive to the trigger event). In one embodiment in which the symbol array is expanded, the expanded symbol array may consist of the symbol array expanded by the defined or selected range for array expansion. In one embodiment in which the symbol array is contracted, the contracted symbol array may consist of the symbol array contracted by the defined or selected range for symbol array contraction. In some embodiments, in the expanded symbol array or the contracted symbol array the defined or selected range for array expansion or array contraction is indicated.

In accordance with some embodiments, a given EGM or other gaming device or game may be operable to resize a symbol array by either contracting or expanding it, or alternating between the two types of symbol array resizing. In accordance with some embodiments, the type of resizing of the symbol array that is implemented for a given game, gaming device or series of related or consecutive game plays that are initiated responsive to a trigger event may differ based on criteria such as different types of trigger events, characteristic(s) of the game play in which the trigger event occurred, wager size, characteristic(s) of a player playing the game, time of day, month or year, current promotions (or may be based on a random determination of which type of resizing to implement). In accordance with some embodiments, in a given game play sequence initiated responsive to a particular trigger event (which may also be referred to as a series of related or consecutive game plays), the symbol array may be resized in one way (e.g., expanded) as between a first game play and a second game play of the plurality of game plays triggered by that trigger event and resized in another way (e.g., contracted) as between a second game play and a third game play of the plurality of game plays.

In other embodiments, a given game or gaming device may be configured to implement only a single type of resizing of the symbol array. For example, a first game may be designed such that the symbol array is resized by expanding it responsive to one or more trigger events while a second game may be designed such that the symbol array is resized by contracting it responsive to one or more trigger events.

In accordance with some embodiments, the control unit is further configured to randomly determine an active symbol array area (e.g., with the help of the RNG) within the resized symbol array. The active symbol array area is used for at least one consecutive game play. In embodiments in which the symbol array is expanded, the upper limit of the active symbol array lies within the defined or selected range of array expansion or contraction—e.g., in embodiments in which the symbol array is being expanded, the smallest possible active symbol array area does not fall below the lower limit of the defined or selected range of array expansion and the largest possible active symbol array area does not exceed, but only equals the upper limit of the defined or selected range of array expansion.

In accordance with some embodiments, there is provided a method of playing a game on an EGM having a display device, an input device, which is configured to receive input from a player to initiate game plays, and a control unit in operative communication with the display and the input device. The control unit is further configured to control game plays to provide a plurality of symbols positioned in a symbol array (e.g., a symbol array comprising a number of rows and columns). The method includes initiating a game play in response to an input of a player via the input device and then determining randomly an outcome of the game play—in some embodiments with the help of an RNG and controlled by the control unit. The method further includes displaying the outcome of the game play in the symbol array on the display, wherein the symbols are randomly arranged within the symbol array in accordance with the outcome.

In accordance with some embodiments, in response to detecting a trigger event (e.g., randomly and non-visibly to the player in a background process during the game play/game logic; displayed in the outcome of game play; exceeding a predefined threshold value; etc.), the method includes the step of randomly defining a range for expansion or contraction of the symbol array. For that purpose the respective range may be defined by the RNG which selects the respective range (e.g., from a plurality of predetermined ranges for array expansion or array contraction). In some embodiments, this selection may be done by the RNG (or another algorithm or combination of hardware and software for performing this function) in a background process and may be visualized in a specific random selection process on the display device in a special display representation. The method may, in some embodiments, further include (i) creating an expanded symbol array and indicating the defined or selected range for array expansion (in embodiments in which the symbol array is being expanded responsive to the trigger event); or (ii) creating a contracted symbol array and indicating the defined or selected range for symbol contraction (in embodiments in which the symbol array is being contracted). In embodiments in which the symbol array is expanded, the expanded symbol array may be a combination of the symbol array and a maximum possible array expansion. In embodiments in which the symbol array is being contracted, the contracted symbol array may be the symbol array minus the maximum possible array contraction. In another embodiment in which the symbol array is expanded, the expanded symbol array may consist of the symbol array expanded by the defined or selected range for array expansion. In another embodiment in which the symbol array is contracted, the contracted symbol array may consist of the symbol array contracted by the defined or selected range for array contraction.

In accordance with some embodiments, the method also includes the step of randomly determining an active symbol array area by the control unit with the help of the RNG. The active symbol array area is then used for the determination of an outcome of at least one consecutive game play. The active symbol array area's upper limit lies within the defined or selected range for array expansion or contraction (e.g., in embodiments in which the symbol array is expanded, the active symbol area only equals the upper limit of the defined or selected range for the maximum array expansion).

In some embodiments, before the consecutive game play is started after a symbol array expansion or contraction, the expanded or contracted symbol array and the different statuses or states of activity of the symbol positions comprising the array (e.g., the status of the rows, columns, symbol positions and/or symbols within symbol positions) are clearly indicated or displayed. Thus, an interface of the game may be modified or generated such that the player can easily distinguish between an active, an inactive and a possibly active symbol or symbol position for the next game play on the display device.

Although some embodiments described herein describe the game and/or methods as being implemented on EGMs such as slot machines and video poker machines, it should be understood that such embodiments may also be deployed on other devices such as on a general purpose computing device or mobile phone in stand-alone form or connected to a network, such as the internet. Further, although some embodiments are described herein in the context of a wagering game, it should be understood that accepting or processing wagers or a wagering environment is not necessary to all embodiments.

Additional aspects of the embodiments described herein will be apparent to those skilled in the art in view of the detailed description of the embodiments, which is made with reference to the drawings. A brief description of the drawings is provided below.

DETAILED DESCRIPTION OF VARIOUS EMBODIMENTS

Figure 1:
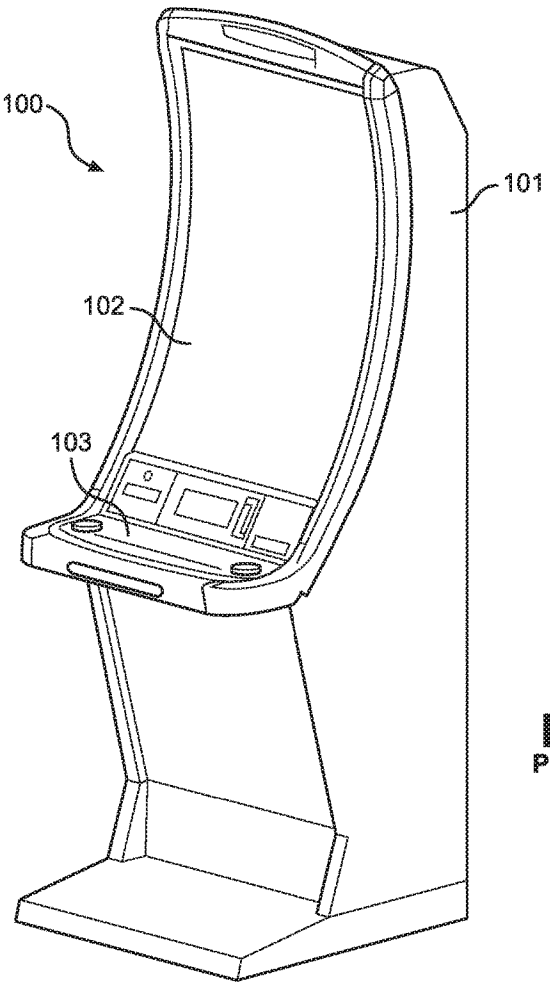
FIG. 1 PRIOR ART
FIG. 1 shows a perspective partial view of a prior art EGM.

Various example embodiments will now be described more fully with reference to the accompanying drawings. It should be understood that the invention(s) encompassed by these example embodiments may be embodied in many different forms and should not be construed as limited to the embodiments set forth herein. Throughout FIGS. 1-17, like elements are referred to by the same reference numerals for consistency purposes.

FIG. 1 shows an EGM 100 in the form of a stand-alone device with a number of components, which device may be utilized to implement one or more embodiments described herein. EGM 100 comprises a housing 101 whose upper half serves to accommodate a display device 102. Display device 102 may comprise a single display unit, but it may also comprise a plurality of separate display units (e.g. 2 or 3 display units), which are capable of independent functionality. Display unit 102 may be, for example, a curved LCD-TFT display unit. Housing 101 of EGM 100 has a window-like cutout in its front side for mounting display device 102 or the display unit. The window-like cutout defines the game play display region in which game contents (e.g. game play and resulting outcomes), game information (e.g. game instructions, pay tables, etc.) and, if appropriate, additional information are displayed on display unit 102.

EGM 100 provides an input device area or an input panel section 103 which may be projected towards the player. Input panel section 103 extends over the entire width of housing 101 of EGM 100. Input panel section 103 may comprise a plurality of manually operable control keys (e.g., in the form of push-button switches, electronic buttons or touch-screen interfaces). Input panel section 103 may also comprise at least one unit for inputting and/or outputting money or play credits, which unit(s) may be embodied in different forms—for example as a coin module, a paper money module such as a bill acceptor also referred to as a bill validator, as a module for tokens and/or as a ticket-in, ticket-out ("TITO") component with capabilities that require a ticket reader and a ticket printer housed inside EGM 100 for accepting bar coded credits printed on a ticket and for which the value of the credits is displayed on meters upon a ticket being inserted. Such devices are well known for use in EGMs and will be referred to collectively as "bill acceptors." In addition, the input panel section 103 may have one or more of a starting key, a handle and a plurality of control keys for the player for example for increasing the game stake, for placing wagers, for retrieving game information or for controlling game functions.

In a preferred embodiment of EGM 100, a single continuous touch panel is arranged in front of display unit 102—which covers the display unit 102 in its entirety or in part. The touch panel covering the display unit 102 may also serve as an input device. The touch panel may be used to initiate game plays and control the game operation. The keys of input panel section 103 on the exterior of EGM 100, as well as the touch panel covering display unit 102 may be used to initiate and to control the EGM 100 by the player.

The game plays displayed on display device 102 are controlled by an electronic control unit; preferably the control unit comprises a processor and a memory for storing information such as game instructions, game logic, etc. In accordance with some embodiments, the control unit is accommodated in the interior of housing 101 (but in other embodiments may be stored in another device, such as a server device in communication with EGM 100). The control unit executes instructions or the game logic that include operation of an RNG. The RNG may comprise software, hardware or a combination thereof and may also be stored in the memory of EGM 100 or in another device (e.g., a server device in communication with EGM 100). Game outcomes may be determined based on the results corresponding to the numbers selected by the RNG or another output of the RNG. Further, the control unit is in operative communication with display device 102 and with input device 103 or its control keys. The control unit may also process a player's inputs entered via the touch panel. In addition, the control unit may actuate the bill acceptor and control at least some of the functions of the EGM 100 and/or game play. In accordance with some embodiments, the EGM 100 may be operable to display, via display unit 102, a symbol array comprising a plurality of symbol positions, in which a plurality of symbols are positioned in order to indicate a randomly defined game outcome. In accordance with some embodiments, the EGM 100 may be programmed (e.g., via a control unit) to perform one or more of the novel and non-conventional functions that are described herein, such as expanding or contracting a symbol array responsive to a trigger event.

Figure 2:
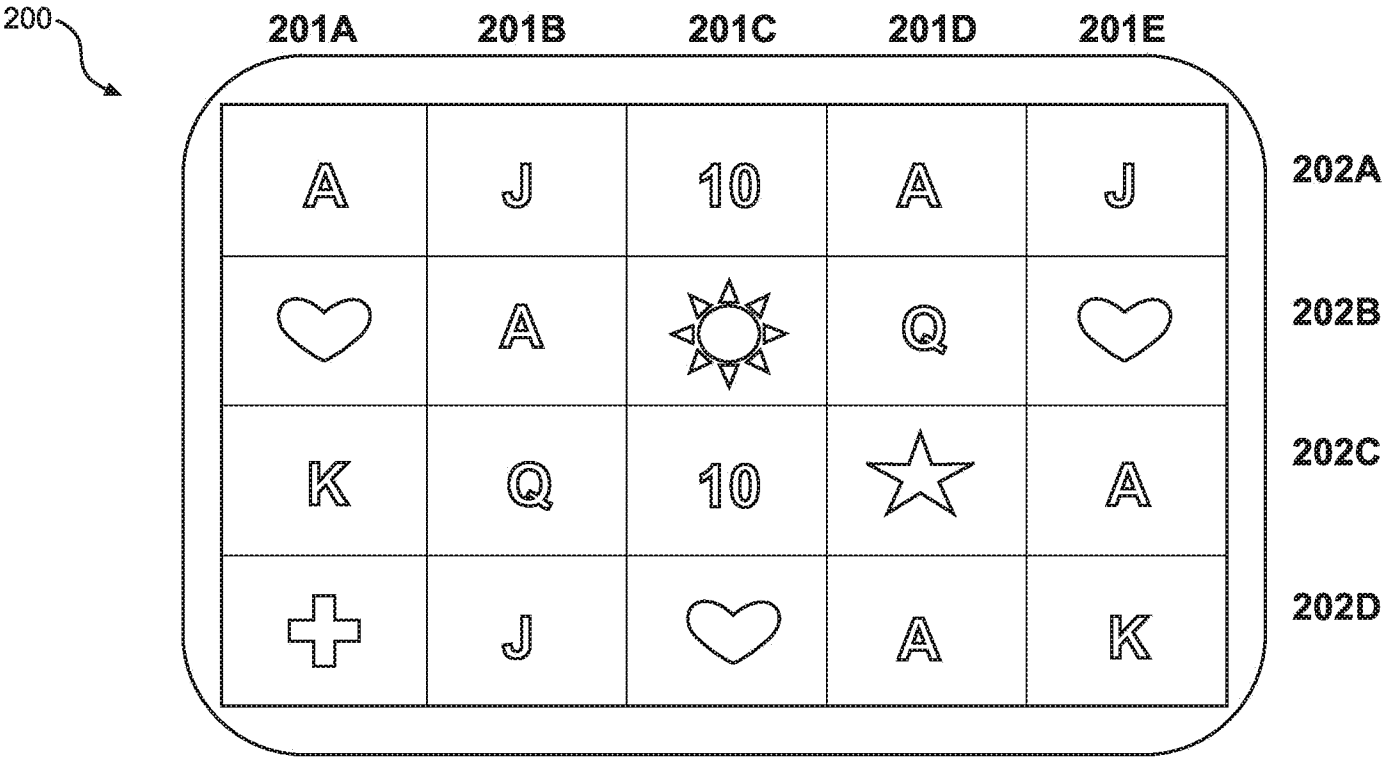
FIG. 2 is an image of an exemplary symbol array of a game displayed on an EGM.

Referring now to FIG. 2, there is illustrated an exemplary symbol array 200 which may be displayed in a game interface, such as on display device 102. The display of symbol array 200 may, in some embodiments, be output in the lower part of display device 102 during game play. In some embodiments, above symbol array 200 other information may be displayed on display device 102 (e.g., pay tables, game instructions, information on game features and/or triggers for game features, etc. (not shown)). In accordance with some embodiments, below symbol array 200 there may be one or more game-session credit meters displayed (not shown) and various touch screen buttons (not shown) adapted to be actuated by the player. A player can operate or interact with the game as required using these touch screen buttons or other input devices like input device panel 103 and the control keys shown in FIG. 1.

The symbol array 200, in accordance with embodiments in which a symbol array may comprise a rectangular matrix, consists of a number of rows 202A, 202B, 202C, 202D and columns 201A, 201B, 201C, 201D, 201E, wherein the columns 201A, 201B, 201C, 201D, 201E represent simulated video reels. Alternatively or additionally, the columns 201A, 201B, 201C, 201D, 201E of the symbol array may be a plurality of mechanical reels, or other mechanical or video representation consistent with the game format and theme. The symbol array 200 shown in FIG. 2 is formatted with five columns 201A, 201B, 201C, 201D, 201E—representing five reels—and four rows 202A, 202B, 202C, 202D. However, it should be understood that any sized or shaped symbol array of columns and rows used on a set of reels would be suitable for implementing the embodiments described herein.

In response to an input of the player, the reels represented by columns 201A, 201B, 201C, 201D, 201E of the symbol array are rotated and stopped to place a plurality of symbols in the positions of the symbol array. The symbols are arranged randomly (based on the randomly determined outcome that the symbols are to represent) in the positions of the symbol array and represent the outcome of a game play. If the displayed symbols represent a winning combination according to the respective game rules, the player is awarded a prize (e.g. credits, etc.).

Figure 3:
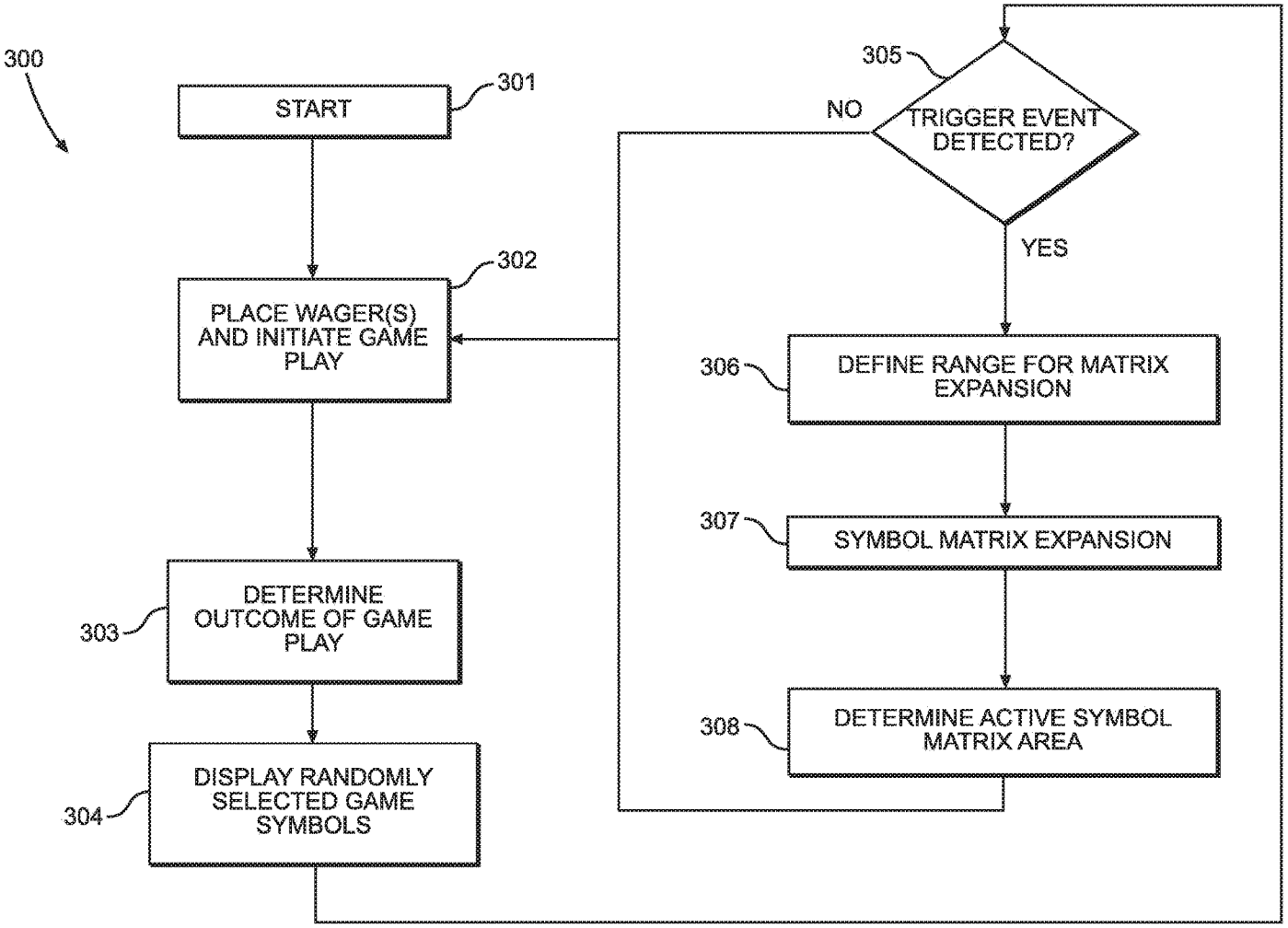
FIG. 3 shows a flow chart of game play with an expansion of the symbol array.

FIG. 3 shows a flow chart 300 of a play sequence including an expansion of the symbol array, for embodiments in which the size of a symbol array is varied by expanding the size. The basic game play may use a group of reels or a symbol array as shown in FIG. 2 which is displayed on a display device 102—preferably a video display or touchscreen video display with a large curved display as shown in FIG. 1. The description of the operation of the game play will be provided with reference to the flowchart of FIG. 3 as well as with reference to FIG. 4 and the screenshots in FIGS. 5A-B and 6A-D.

The first step of game play is at start 301 which represents the point where a player sits down to play at EGM 100, for example, but it may also represent a point during a gaming session where the player initiates a new basic game play. If the player starts to play, he/she initially inserts a bill, ticket or coins into a slot through which access is gained to a bill acceptor of the EGM 100 to load credits on the EGM 100. The credits may be displayed to the player on a credit meter on display device 102. For the purpose of this description, the basic game play will be a spinning reel slot game on a video display device 102 with a large, curved display.

A wager is placed and the game is started using the buttons or control keys of input device 103 to initiate game play at a step 302, A symbol array 200 as shown in FIG. 2 is displayed on display device 102, in which a plurality of symbols is positioned in columns 201A, 201B, 201C, 201D, 201E—representing the reels—and rows 202A, 202B, 202C, 202D. Once game play is initiated at step 302, appropriate game graphics are shown on display device 102 such as spinning reels, which may be accompanied by corresponding game sounds from speakers on EGM 100. At step 303, the outcome of game play is determined. During step 303, an RNG provides one or more random numbers which are received by the control unit to control game play and to define the outcome of game play based on the results corresponding to the numbers selected by RNG.

Figure 4:
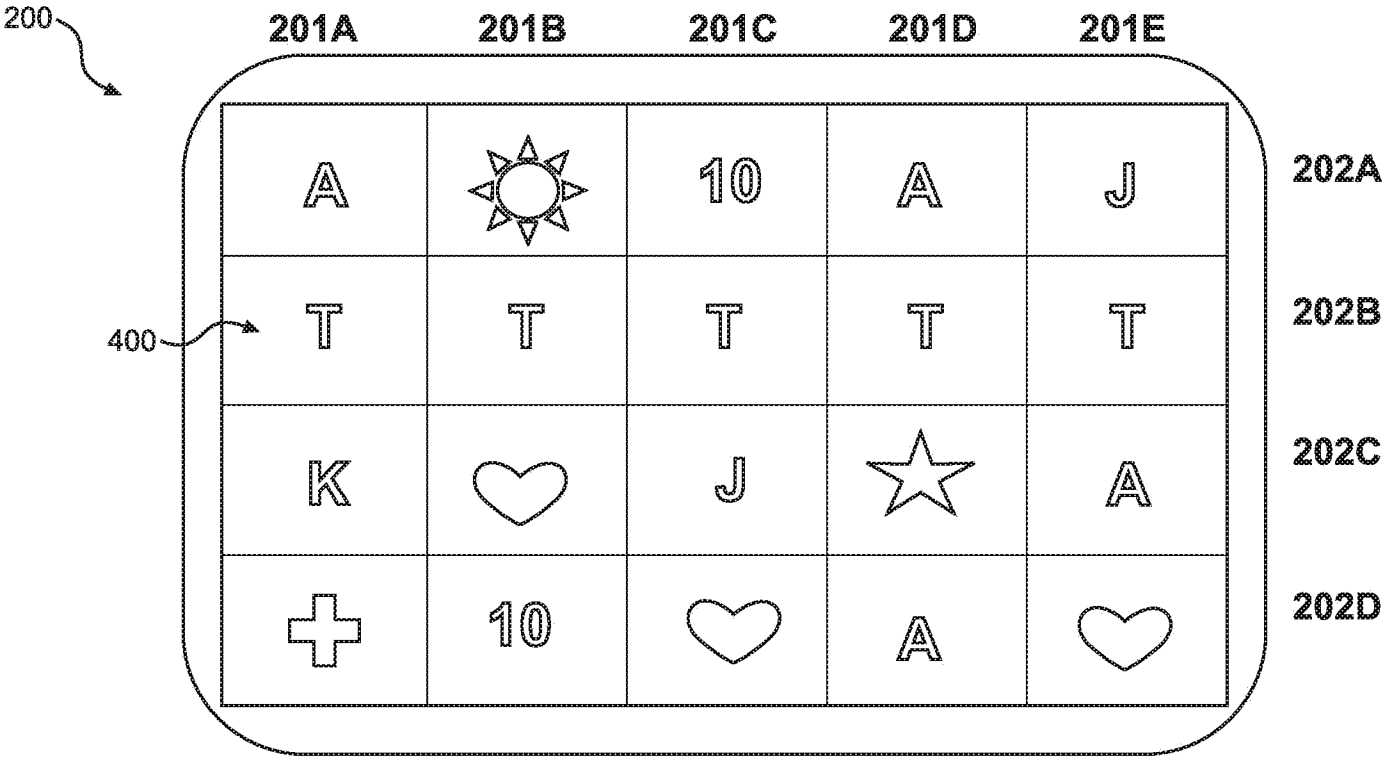
FIG. 4 shows a game symbol array in which an event triggers symbol array expansion.

Once the outcome is reached, the reels are stopped and the outcome is displayed in symbol array 200 as shown in FIG. 2. Symbol array 200 consists of positions each containing a randomly selected symbol displayed on display device 102 for the player to see at step 304. At step 305, it is determined, if a trigger event was detected either during the process of game play or in the outcome of the game. In FIG. 4 an example of a possible trigger event 400 is shown. FIG. 4 illustrates symbol array 200 with columns 201A, 201B, 201C, 201D, 201E and rows 202A, 202B, 202C, 202D. A plurality of symbols is displayed in the positions of symbol array 200 with five special symbols "T" in row 202B qualifying as a trigger event 400. The special symbol T may be a so called scatter symbol or any other special symbol having a trigger function. The special symbol T may occur as a grouping e.g. five in row as trigger event 400 (as shown in FIG. 4), but any other combination of the special symbol T may also be used as trigger 400 (e.g. a certain number of the special symbol T in row or in column, a certain number of the special symbol T in the symbol array). Alternative or additionally, there may be other trigger events 400, e.g. collecting a predetermined number of a special symbol T, etc. in a single game or in a predefined number of games.

In another embodiment, the trigger event may be only a software-implemented trigger, which occurs randomly during game operation by the control unit (e.g., with the help of the RNG). The occurrence of the trigger event may be detected by the control unit during the process of a game play, but the trigger event itself is not made visible to the player. A feature like an expansion of the symbol array triggered by that trigger event may appear as a kind of mystery feature. In this embodiment, only the start of the feature may be announced to the player on display device 102, but the trigger event itself may be hidden.

If no trigger event 400 occurs during the game play sequence or is detected by the control unit in the symbol array 200, possible winning outcomes are determined and the game play ends at step 305. In that case, the player is returned to step 302 to place a wager and initiate game play again, if desired. If a trigger event 400 occurs or is detected by the control unit or is detected in the symbol array 200 at step 305 and as shown in FIG. 4, then game play proceeds at step 306—starting the process of expanding symbol array 200.

At step 306, in response to detected trigger event 400, a range of random array expansion possibilities of symbol array 200 is defined. The range for array expansion may be any range of rows, columns or both (or, in some embodiments, individual symbol positions may be added to the array, not necessarily as part of entire rows or columns)—with an upper limit being lower or equal to a predetermined maximum expansion area which may define the maximum number of rows or columns or both to be added to the symbol array 200. Alternatively or additionally, the range for array expansion may be selected from a predetermined number of array expansion possibilities. The range for array expansion is determined by the RNG which selects the respective range in a specific random selection process controlled and executed by the control unit. The probability for each selectable range for array expansion may be either equal or pre-weighted by the respective game instructions which are executed by the control unit. The specific random selection process may be a background process executed and operated by the control unit or it may be displayed to the player.

Figure 5B:
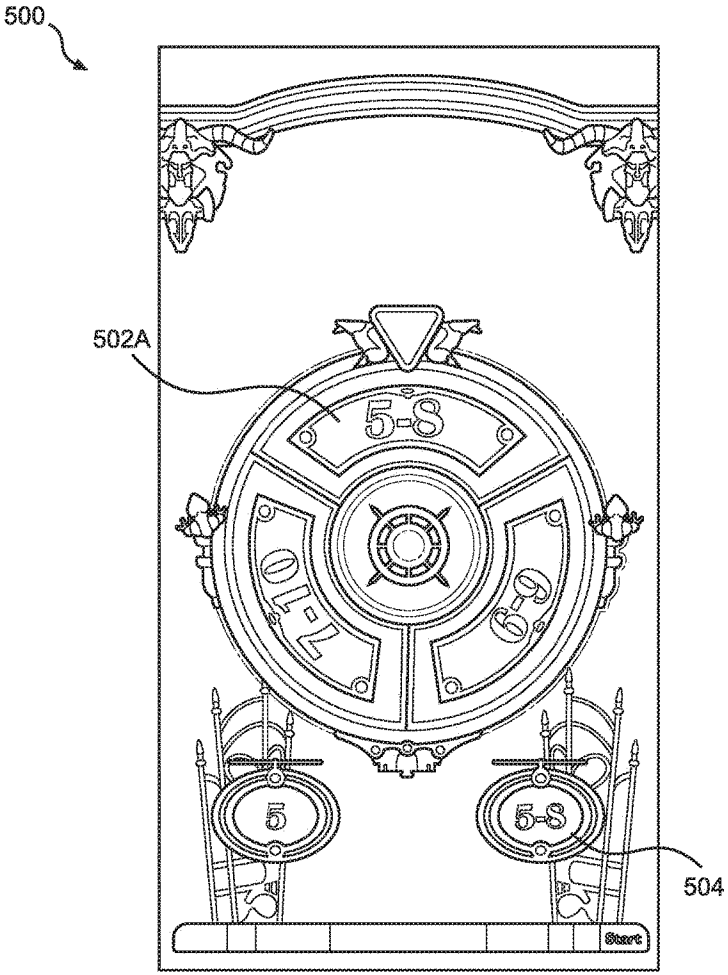
FIGS. 5A-B show illustrative screen shots of a game play sequence in which the range of symbol array expansion is determined.
Figure 5A:
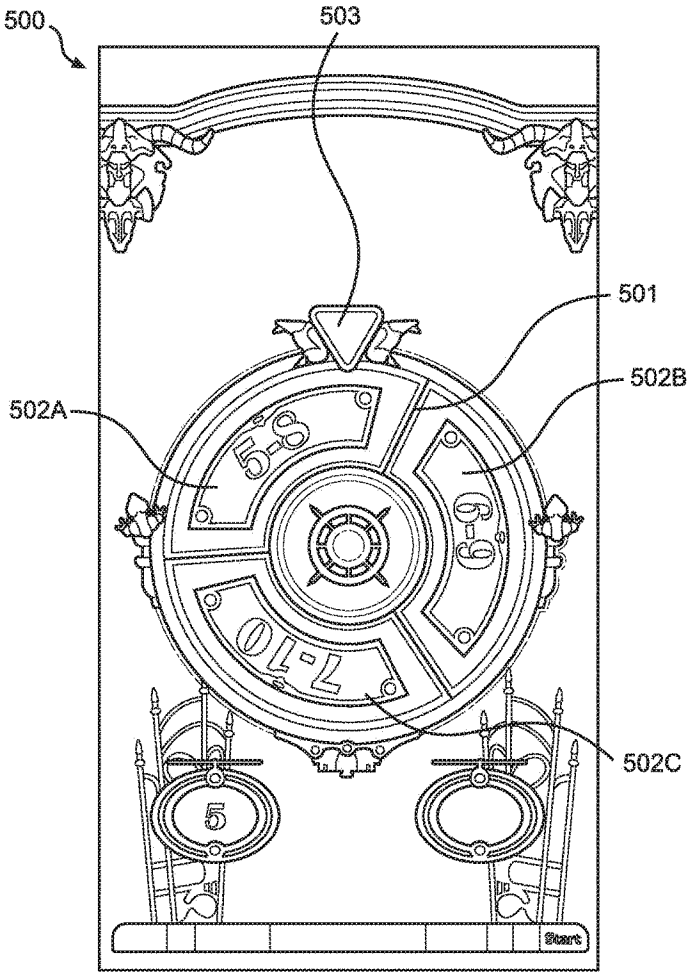

As shown in FIGS. 5A-B, the specific random selection process of the range of possible array expansion possibilities may be displayed in a special graphic representation 500 or special display representation 500 on display device 102 to the player. The visual representation of the specific random selection process may be conducted with the help of a wheel 501, for example, but any other representation of a selection may also be used—e.g. a moving belt, turning extra reel, temperature gauge, etc. Wheel 501 as shown in FIG. 5A has three sectors 502A, 502B, 502C from which a selection is made. Each sector 502A, 502B, 502C shown in FIG. 5A represents an area of expansion range possibilities of symbol array 200 or of an extended symbol array. It should be understood that more or fewer sections could be used. In FIG. 5A a first sector 502A represents a range of row five to eight, a second sector 502B represents a range of row six to nine and a third sector represents a range of row seven to ten, for example. Alternatively or additionally, more sectors for selection may be defined and the selection process is not limited to ranges of rows for an extended symbol array. It is also possible to define ranges of columns or ranges of rows and columns. The wheel 501 has also an indicator 503 to mark a selected sector 502A, 502B, 502C after the specific random selection process has been executed.

Wheel 501 is turned for the selection of a specific range for array expansion. The outcome of the specific random selection process is determined by the RNG in the background and displayed after wheel 501 has stopped—as shown in FIG. 5B. Indicator 503 defines the selected sector—which in the case of FIG. 5B is the first sector 502A defining a range of rows five to eight for array expansion. Additionally, the outcome of the specific random selection process may be displayed to the player in a display plate 504.

The specific random selection process for defining the range for array expansion may be coupled with selection processes of parameters for game play (e.g. number of bonus games or free games, etc.). For example, a number of free games or bonus games may be determined in a first random selection process and then in a second random selection process the range for array expansion is selected. The selected range for array expansion may be used for the determined number of free games or bonus games. If a wheel representation for both selection processes is used, the wheel may consist of two wheels—e.g. an outer wheel for the first selection process (e.g. number of free games) and an inner wheel for the second selection process (e.g. range for array expansion). After the first selection process or the number of free games has been determined, there may be a transition from the outer wheel to the inner wheel, in which the inner wheel is enlarged and the outer wheel disappears—supported by graphical effects on display device 102 to increase the player's excitement and entertainment.

Figure 6B:
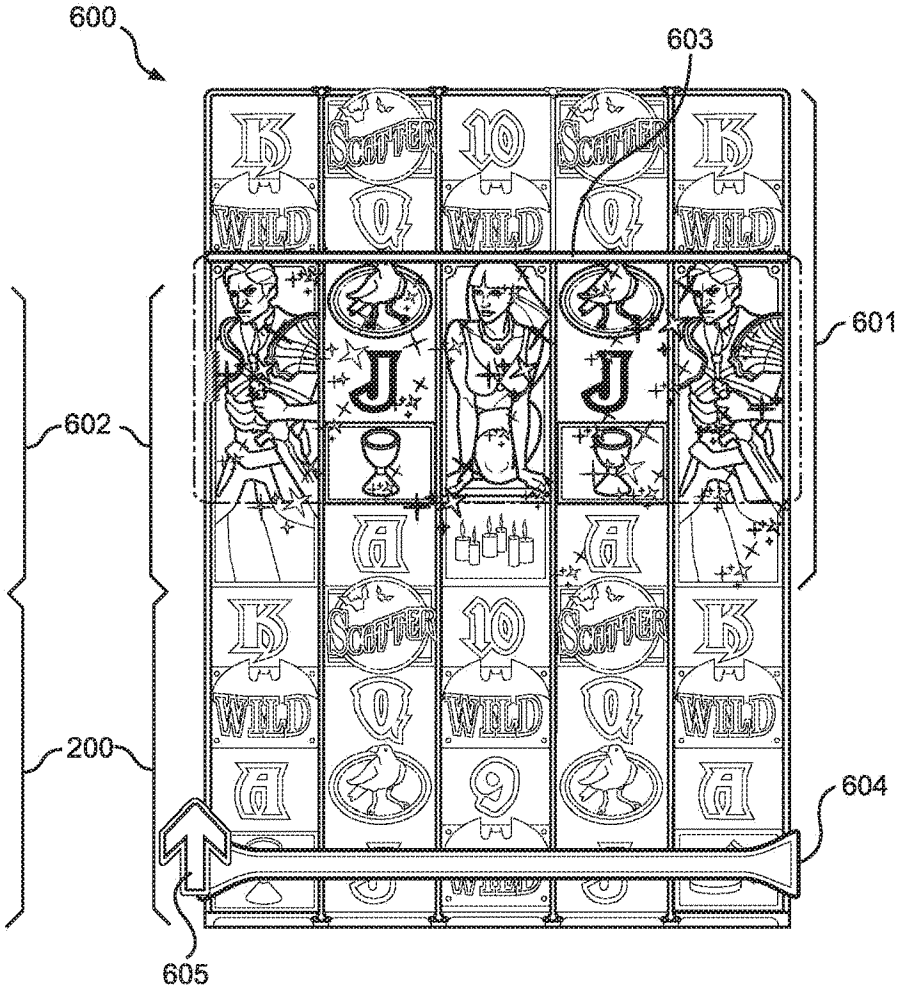
FIGS. 6A-D show illustrative screen shots of an alternative game play sequence showing an expansion process of the symbol array.
Figure 6A:
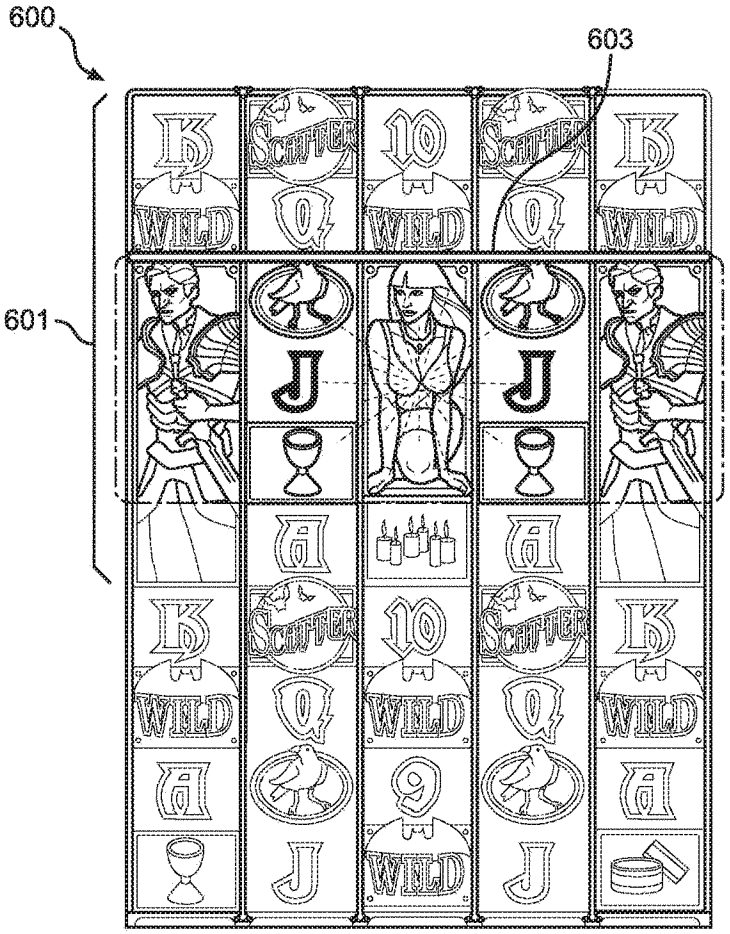

At step 307 of FIG. 3, an extended symbol array 600—as shown in FIGS. 6A-D—is created and displayed on display device 102. The defined or selected range for array expansion 602 is indicated in the extended symbol array 600 on display device 102. The extended symbol array 600 shown in FIG. 6A consists of symbol array 200 to which a maximum array expansion area 601 is added. The expansion of symbol array 200 is done vertically by adding rows in this specific embodiment of the invention. As shown in FIG. 6A, six rows may be added as maximum array expansion area 601 for example. Extended symbol array 600 thus illustrates the maximum possible active symbol array which may be achieved for a game play, if a respective range of array expansion (e.g. row seven to ten) was randomly selected in the specific random selection process. Since the selected range of array expansion in this specific embodiment of the invention is only row five to eight (as shown in FIGS. 5A-B), this range 602 is marked in the extended array in FIG. 6A to indicate a possible active symbol array area to the player. A line indicator 603 indicates the maximum number of possible rows within the selected range 602. Below the line are eight rows, which is the highest value of the five to eight range selected in step 306 of FIG. 3.

In another embodiment, the extended symbol array 600 may only consist of the symbol array 200 used in a basic game play and the range for array expansion 602, which was selected or defined in the specific selection process. The extended symbol array 600 then indicates the possible active symbol area to the player.

In another embodiment of the invention, the expansion of the symbol array 200 may be a horizontal expansion—by adding a number of columns or reels. In this case, the expansion range may be added on the right side, on the left side, on both sides or in between existing columns of symbol array 200. The defined range for array expansion may be marked graphically using highlighting or by displaying a line—e.g. as shown in FIG. 6A for adding rows. In another embodiment of the invention, the expansion of symbol array 200 may add an expansion area consisting of both rows and columns. The expansion of the symbol array 200 may be diagonal—if the rows and columns are added e.g. on the upper and right side or the lower and left side, etc. The expansion of the symbol array 200 may be adding rows and columns on all of its sides, as well. In any case, a defined or selected range for array expansion may be indicated to the player to mark a possible active symbol array area the player may achieve for at least one consecutive game play.

At step 308 in FIG. 3, an active symbol array area is determined randomly with the use of the RNG. The determined active symbol array area is used for at least one consecutive game and may be randomly changed after that consecutive game has been played, especially if the defined range for array expansion was selected for more than one game. It is preferred that the active symbol array area is larger than symbol array 200. The upper limit of the active symbol array area lies within the selected range for array expansion 602 as selected at step 306, and it does not exceed the maximum limit indicated by indicator 603 and defined by the selected range for array expansion 602 on wheel 501. The probability for determining a particular active symbol array area for e.g. the next game play may be either equal or pre-weighted by the respective game instructions which are executed by the control unit.

Figure 6D:
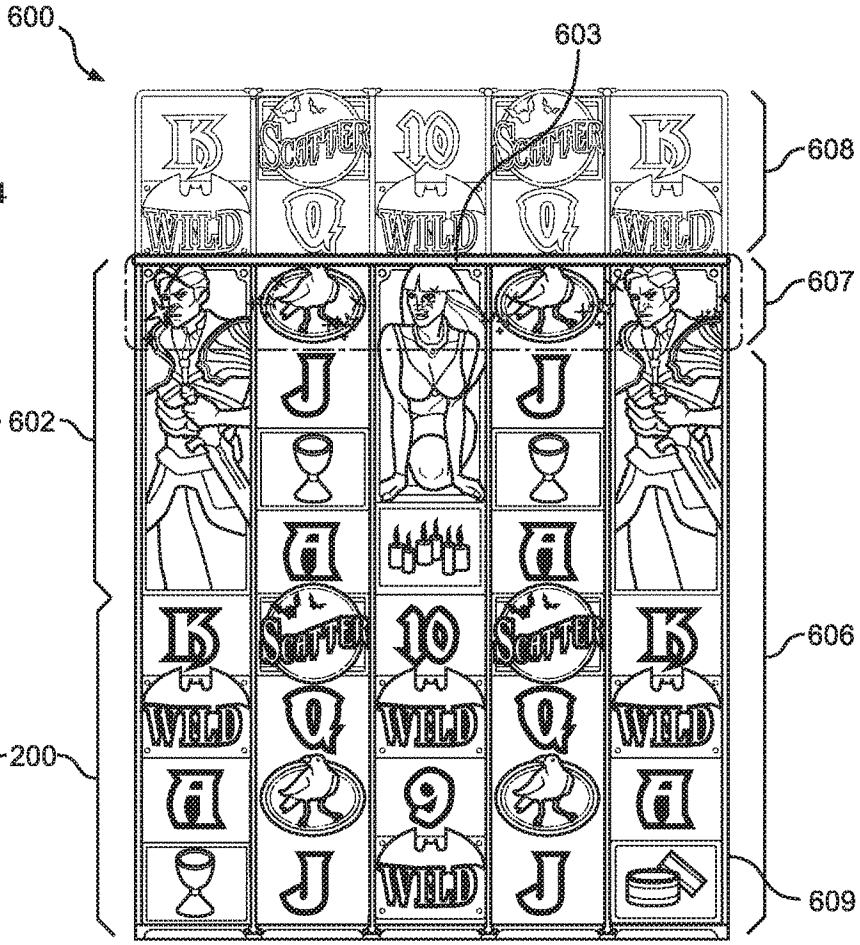
Figure 6C:
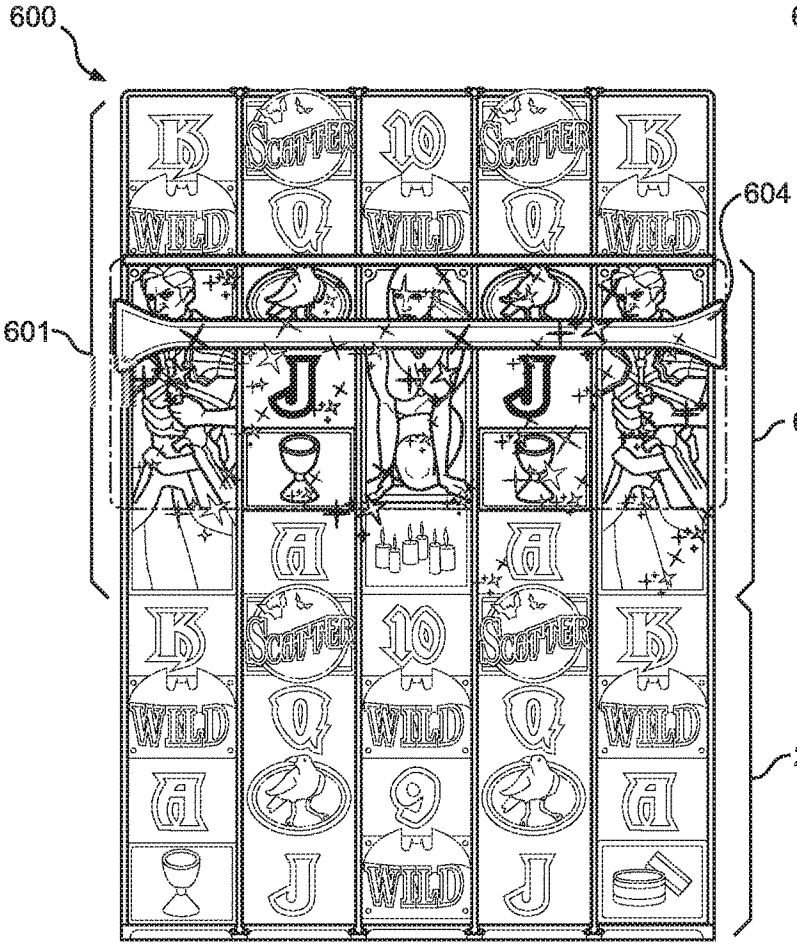

FIGS. 6B-D show screen shots of an alternative game play sequence showing an expansion process of symbol array 200 and a determination of an active symbol array area. FIG. 6B shows the extended symbol array 600 with the marked range for array expansion 602—the marking may be done by using special graphical effects, highlighting, indicators on the respective sides of the extended symbol array 600, etc. To show the determination of the active symbol array area, an indicator 604—e.g. a moving line, a meter on the side of extended symbol array 600, etc.—may be used. In this specific embodiment of the invention as shown in FIG. 6B, a line indicator 604 moves up in the direction of arrow 605. In FIG. 6C the line indicator 604 moves until movement is stopped at the proper position for the number of expanded places based on the determination process of the active symbol area in step 306.

FIG. 6D shows the extended symbol array 600 after the determination of the active symbol area 606 in this specific embodiment of the invention. Active symbol area 606 may be shown to the player in color or in another format that distinguishes it from the remainder of the symbol array, to give the player a clear indication of the number of rows to be played in the next game play. An area 607 of the expanded symbol array 600 between active symbol array area 606 and line indicator 603, which indicates the maximum number of rows within the selected range 602, shows the area of the expanded symbol array 600, which might possibly be chosen as part of active symbol array area 606 in a next determination process using the same range for array expansion 602. This area 607 may be specially marked or high-lighted, to indicate possibly active areas to the player on display device 102. An area 608 above the line indicator 603 of the expanded symbol array 600—if the maximum array expansion area 601 is displayed—may be marked as inactive area. For example, area 608 of the expanded symbol array 600 may be colored in grey—to show that this area 608 is out of the defined or selected range for array expansion 602. Alternatively or additionally, the determined active symbol array area 606 may be marked with at least one meter 609 (e.g., on the left hand side or on the right hand side or on both sides of the expanded symbol array 600). In accordance with some embodiments, the meter 609 shows the number of rows that are active. The height 608 of the meter may be set to the respective row of the active symbol array area 606 after the current determination process.

After the active symbol area 606 is determined and displayed to the player on display device 102, the player can place wagers and initiate the next game play. In this game play the active symbol array area 606 is used for arranging symbols randomly and for determining the outcome as well as any winning combination(s). The use of an expanded symbol array 600 may be also used in a bonus round—just for one game play—that is triggered by a trigger event 400 in a basic game play. In an alternative implementation, the symbol array expansion and the expanded symbol array 600 may be used for a number of consecutive game plays (e.g. number of bonus game/free games, etc.). In case a number of consecutive games are played with expanded symbol array 600, the defined or selected range for symbol array expansion may be determined for the whole number of game plays, before the first game is initiated. Active symbol array area 606 may be determined independently before each game for the number of game plays, wherein the upper limit of the selected range for array expansion 602 defines the possible maximum expansion of the active symbol array area 606 for the whole number of game plays. Alternatively, the range of array expansion 602 and active symbol array area 606 may be determined to be the same for all games of a number of consecutive game plays.

It should be understood that the array expansion process and the respective game play as described and shown in FIGS. 3-6 is illustrative only. It is possible to vary the size of symbol array 200 in different ways. For example, as already mentioned an expansion of symbol array 200 with columns or with rows and columns may also be possible to provide a variety of possible expanded symbol matrices 600 as well as a variety of possible active symbol array areas 606—both increasing entertainment and excitement for the players. In other embodiments, the symbol array may be contracted or its size decreased responsive to a trigger event, rather than increased. Such embodiments are described in more detail with respect to FIGS. 12-17.

Figure 7C:
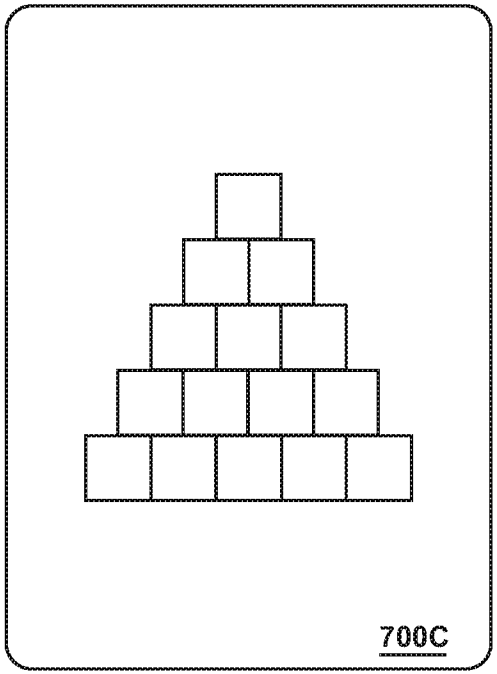
FIGS. 7A-C show illustrative screen shots of an alternative game play sequence showing an expansion process of the symbol array having a triangular shape.
Figure 7B:
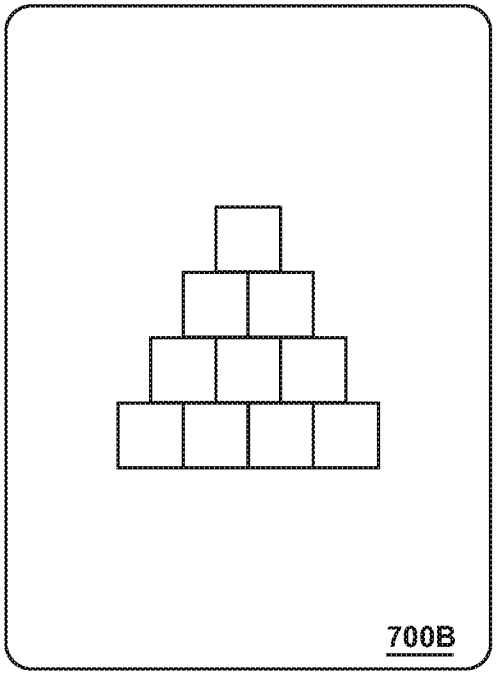
Figure 7A:
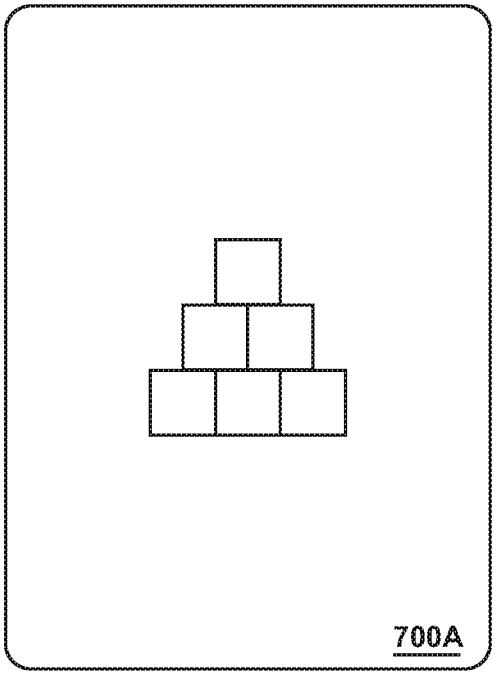

Further, as described above, the embodiments described herein are not dependent on any particular shape of a symbol array and the rectangular symbol array shapes illustrated in FIGS. 4 and 6A-6D are examples only. FIGS. 7A-C (collectively "FIG. 7" herein), 8A-C (collectively "FIG. 8" herein), 9A-C (collectively "FIG. 9" herein), 10A-C (collectively "FIG. 10" herein) and 11A-C (collectively "FIG. 10 herein) illustrate various other example shapes that a symbol array may be embodied as. In each respective set of these figures (e.g., FIGS. 7A-C being one set, FIGS. 8A-C being another set, etc.), a symbol array of a certain shape is illustrated as progressively expanding over a course of game plays. Thus, for example, FIG. 7A illustrates the symbol array 700A as it may be output to a player in a first game play, FIG. 7B illustrates symbol array 700B that is an expansion of the symbol array 700A as it has been expanded after the first game play and for a second, subsequent game play (e.g., responsive to a trigger event having been detected in the first game play) and FIG. 7C illustrates symbol array 700C that is an expansion of the symbol array 700B as it has been expanded after the second game play and for a third game play that is subsequent to the first game play.

It should be noted that the expansion of each example shaped symbol array shown in FIGS. 7-11 may be expanded in accordance with any or all of the processes and game mechanics described herein with respect to FIGS. 3, 4, 5A-B and 6A-C. For example, (i) a trigger event (the occurrence of which may be determined in accordance with the embodiments described with respect to step 305 of process 330 of FIG. 3) may cause an expansion of the symbol matrix; (ii) a size or range of symbol expansion may be determined via a random process (e.g., such as is described with respect to step 306 of process 300 (FIG. 3) and FIGS. 5A-B) and (iii) an active symbol area may be determined in a manner similar to that described with respect to FIG. 6. These processes and game mechanics for how a symbol array expansion may be triggered or implemented will not be repeated with respect to FIGS. 7-11 for purposes of brevity.

Turning now to FIGS. 7A-C in particular, illustrated therein is a symbol array in which the plurality of symbol positions are arranged in an upright triangle shape, with the apex of the triangle being positioned as the top-most symbol position. As with the embodiments described herein regarding a symbol array having a rectangular shape, the symbol array of FIG. 7 can be expanded in response to a trigger event. In the example of FIG. 7, illustrating an example expansion mechanic of a triangle shaped symbol array, the symbol array 700A (FIG. 7A) progresses/expands to the symbol array 700B (FIG. 7B) then further to the symbol array 700C (FIG. 7C) by successively adding symbol positions comprising an additional bottom row of the triangle, thus adding a new row and expanding the base of the triangle. Of course in other embodiments a triangle shaped symbol array may be expanded by adding symbol positions in another manner (e.g., adding an additional symbol position to the top of the triangle and symbol positions to each other existing row of the triangle).

In some embodiments, an expansion of a symbol array may cause the symbol array to lose or change its original shape. For example, if the expansion of the triangle shape comprising symbol array 700A comprised adding symbol positions only to the middle row, the resulting symbol array would no longer be in the shape of a triangle. The embodiments described herein are not dependent on symbol positions being added, in the process of expanding the symbol array, to any particular portion, side or area of a symbol matrix.

Figure 8C:
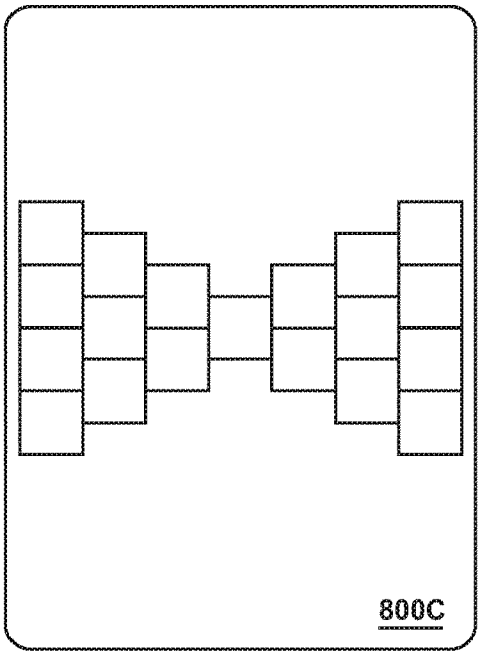
FIGS. 8A-C show illustrative screen shots of an alternative game play sequence showing an expansion process of the symbol array having a non-traditional or "ribbon" shape.
Figure 8B:
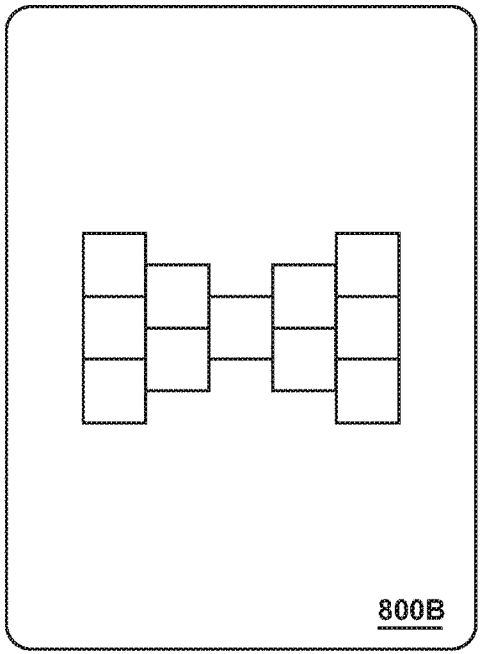
Figure 8A:
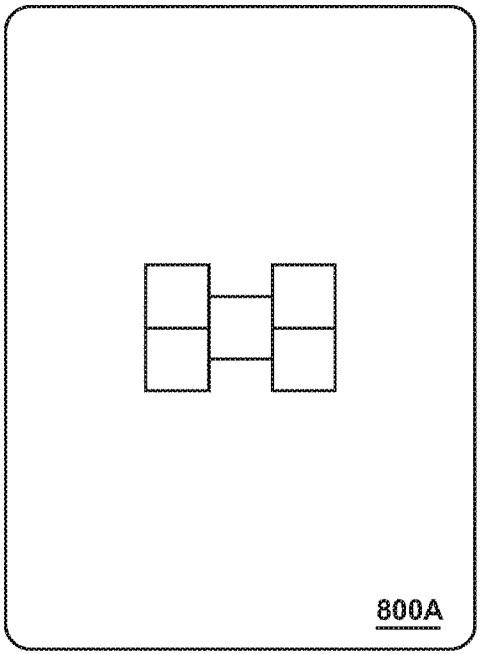

Turning now to FIGS. 8A-C, illustrated therein is a symbol array in which the plurality of symbol positions are arranged in a ribbon or bow shape, with the center-most symbol position comprising a low point of the resulting ribbon or bow. As with the embodiments described herein regarding a symbol array having a rectangular shape, the symbol array of FIGS. 8A-8C can be expanded in response to a trigger event. In the example of FIG. 8, illustrating an example expansion mechanic of a ribbon or bow shaped symbol array, the symbol array 800A (FIG. 8A) progresses/expands to the symbol array 800B (FIG. 8B) then further to the symbol array 800C (FIG. 8C) by successively adding symbol positions comprising an additional column to the each outermost edge of the ribbon/bow. Of course in other embodiments a ribbon or bow shaped symbol array may be expanded by adding symbol positions in another manner (e.g., adding an additional symbol position to the top and/or bottom symbol position in each existing column).

Figure 9A:
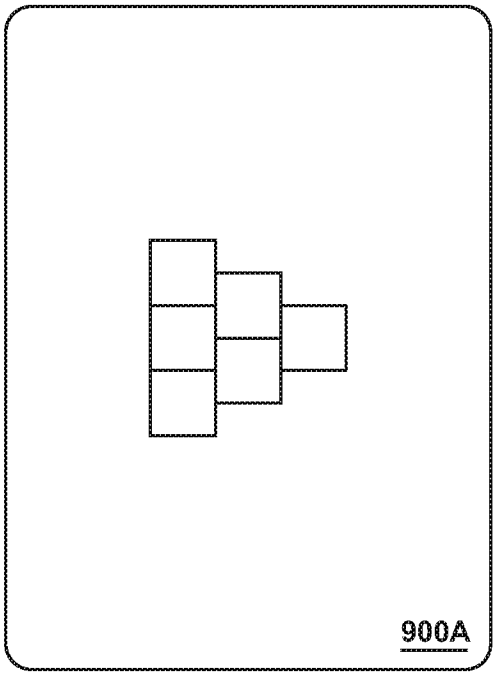
FIGS. 9A-C show illustrative screen shots of an alternative game play sequence showing an expansion process of the symbol array having a triangular shape positioned sideways.
Figure 9B:
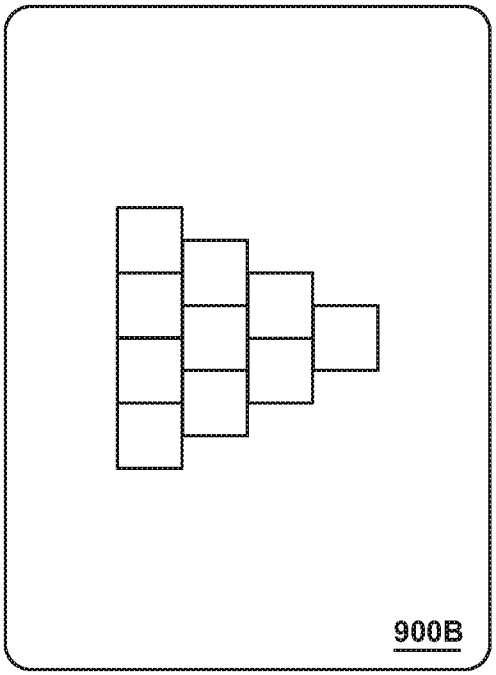
Figure 9C:
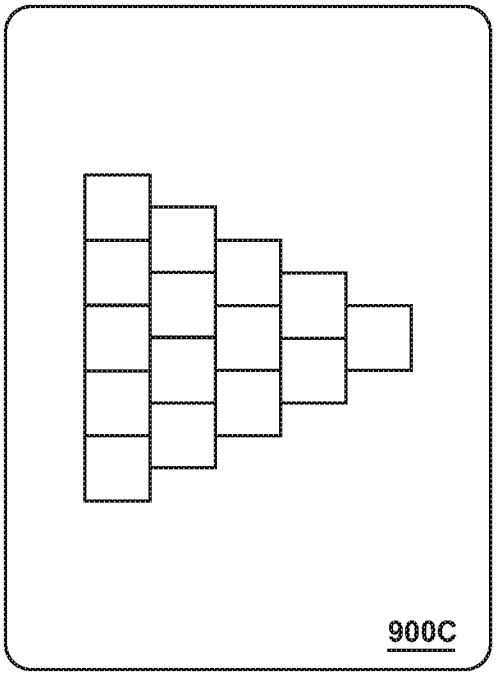

Turning now to FIGS. 9A-C, illustrated therein is a symbol array in which the plurality of symbol positions are arranged in a sideways triangle shape, with the apex of the triangle being positioned on a side of the triangle rather than at the top of the triangle. As with the embodiments described herein regarding a symbol array having a rectangular shape, the symbol array of FIGS. 9A-9C can be expanded in response to a trigger event. In the example of FIG. 9, illustrating an example expansion mechanic of a sideways triangle shaped symbol array, the symbol array 900A (FIG. 9A) progresses/expands to the symbol array 900B (FIG. 9B) then further to the symbol array 900C (FIG. 9C) by adding an additional column to the side of the triangle opposite the apex, or as the new "base" of the sideways triangle. Of course in other embodiments a sideways triangle shaped symbol array may be expanded by adding symbol positions in another manner (e.g., adding an additional symbol position adjacent to the apex (i.e., adding anew column comprising a single symbol position) as a new apex of the triangle and adding a symbol position to each existing column).

Figure 10C:
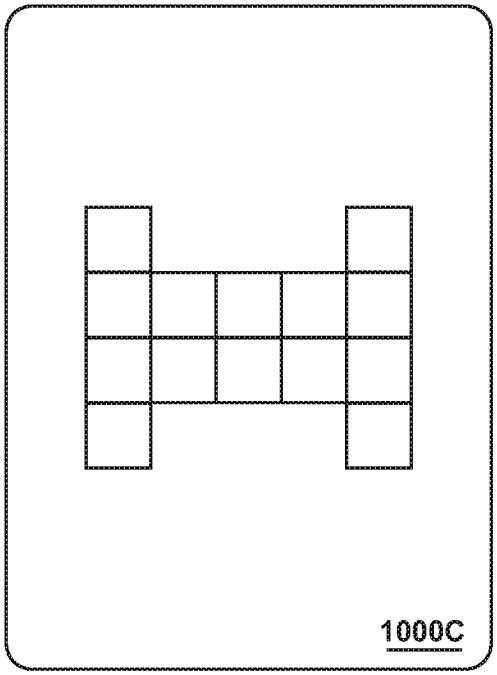
FIGS. 10A-C show illustrative screen shots of an alternative game play sequence showing an expansion process of the symbol array having an H-beam shape.
Figure 10B:
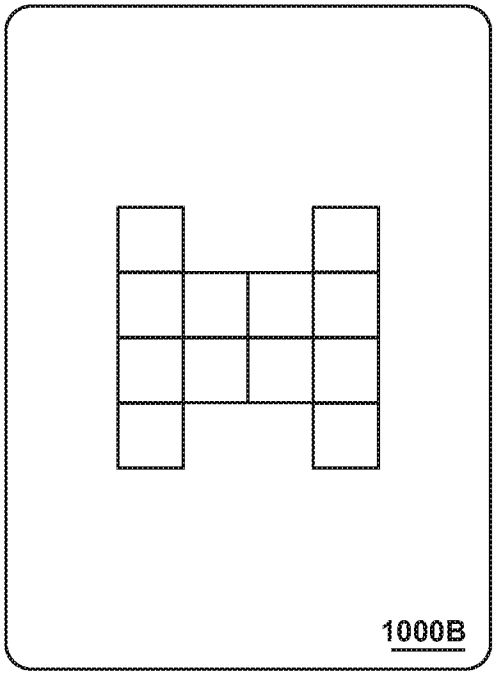
Figure 10A:
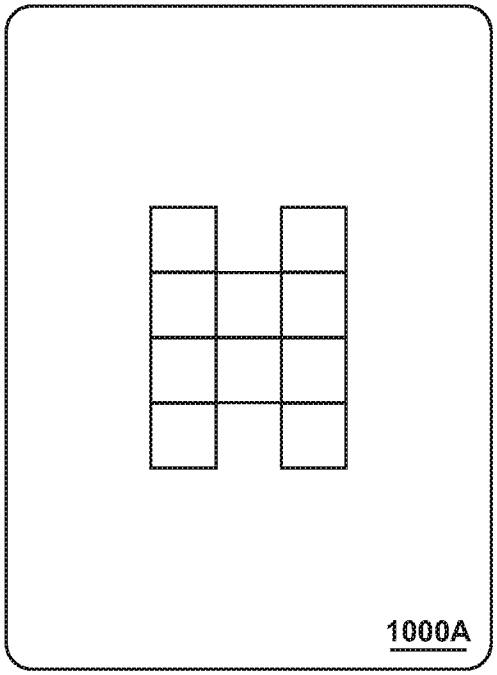

Turning now to FIGS. 10A-C, illustrated therein is a symbol array in which the plurality of symbol positions are arranged in an H-Beam shape. As with the embodiments described herein regarding a symbol array having a rectangular shape, the symbol array of FIGS. 10A-10C can be expanded in response to a trigger event. In the example of FIG. 10, illustrating an example expansion mechanic of a H-Beam shaped symbol array, the symbol array 1000A (FIG. 10A) progresses/expands to the symbol array 1000B (FIG. 10B) then further to the symbol array 1000C (FIG. 10C) by adding an additional column to the center section of the H-Beam, thus successively widening the center section. Of course in other embodiments an H-Beam shaped symbol array may be expanded by adding symbol positions in another manner (e.g., adding an additional symbol position to the top and/or bottom of each existing column or to the edge columns, thus making the H-Beam shape look "taller").

Figure 11C:
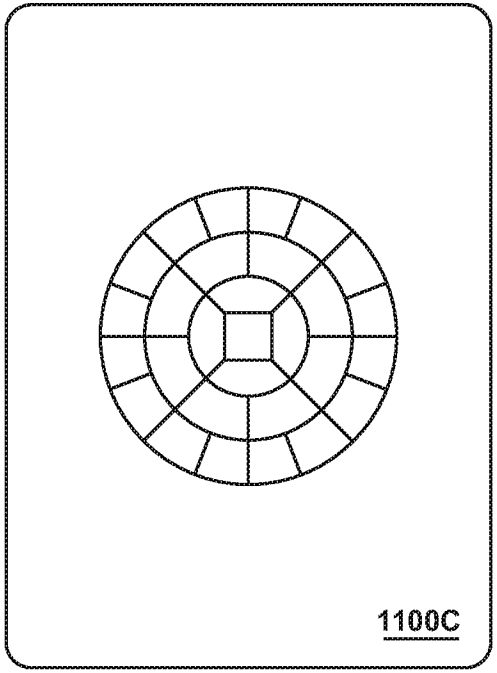
FIGS. 11A-C show illustrative screen shots of an alternative game play sequence showing an expansion process of the symbol array having a circular shape.
Figure 11B:
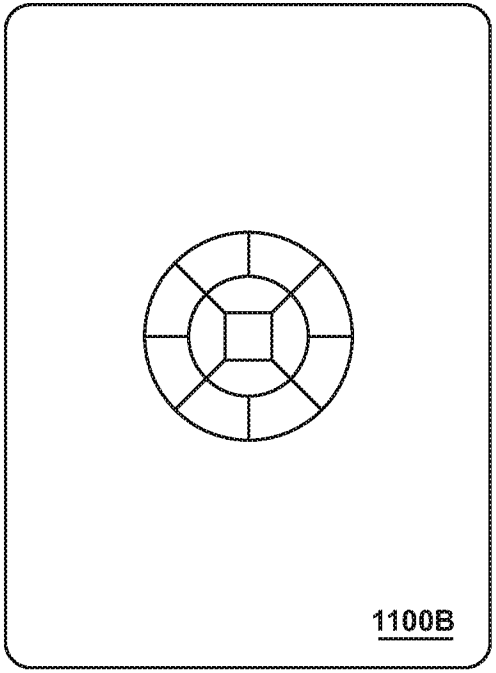
Figure 11A:
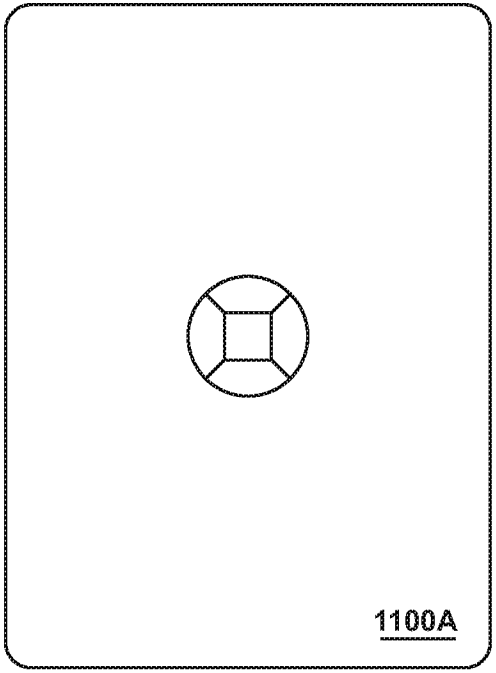
Figure 12A:
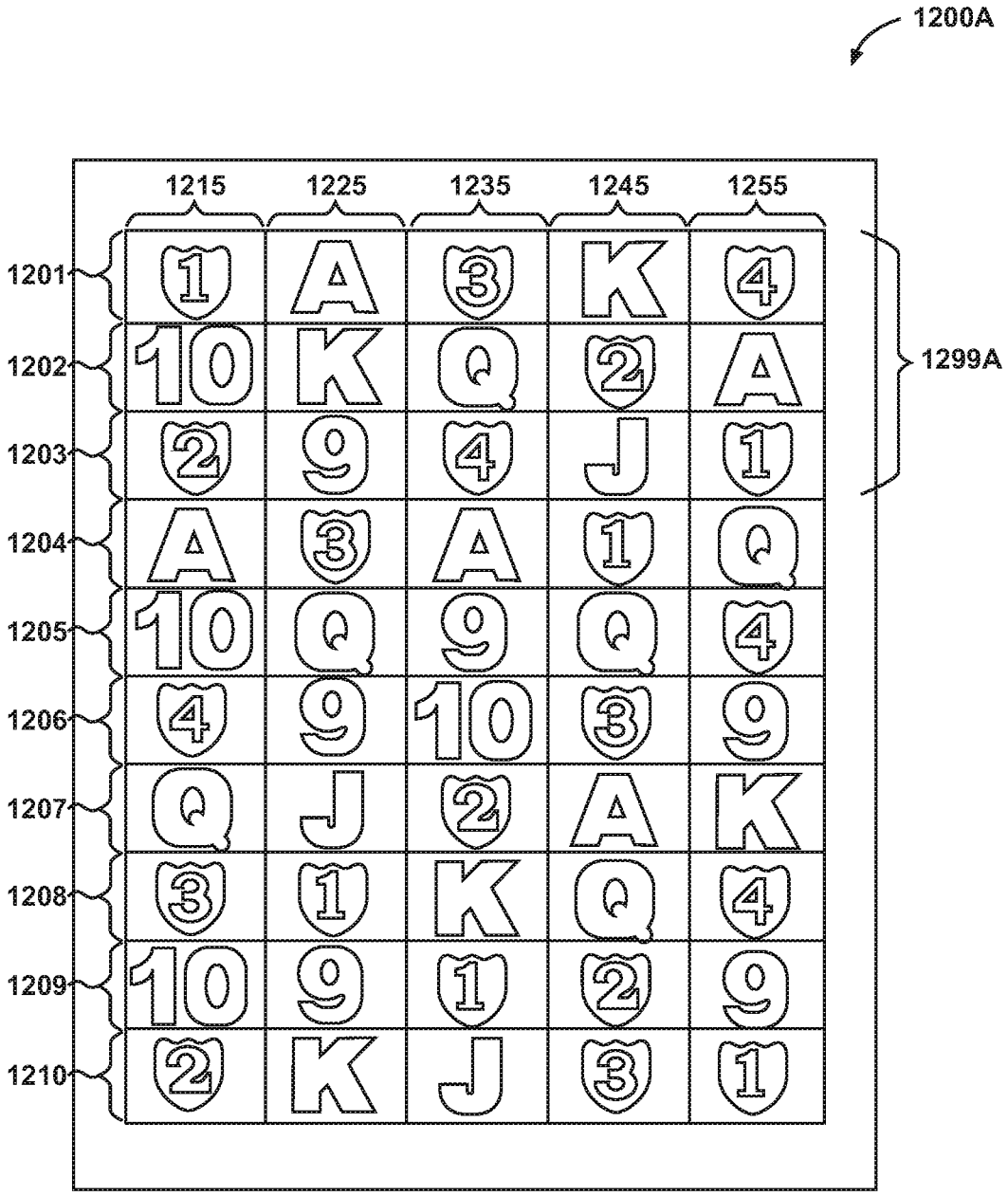
FIGS. 12A-C show illustrative screen shots of an alternative game play sequence showing contraction process of the symbol array.
Figure 12B:
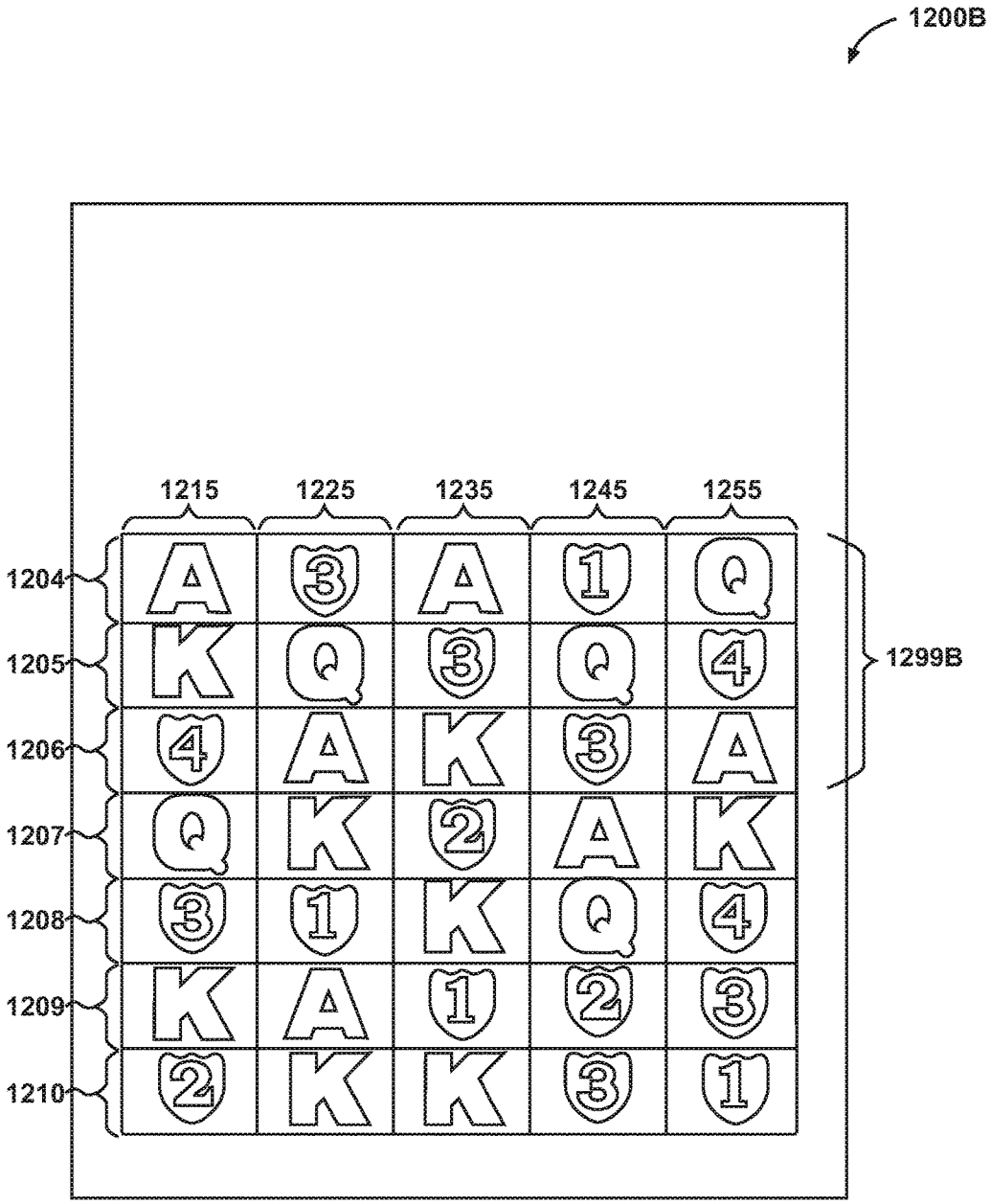
Figure 12C:
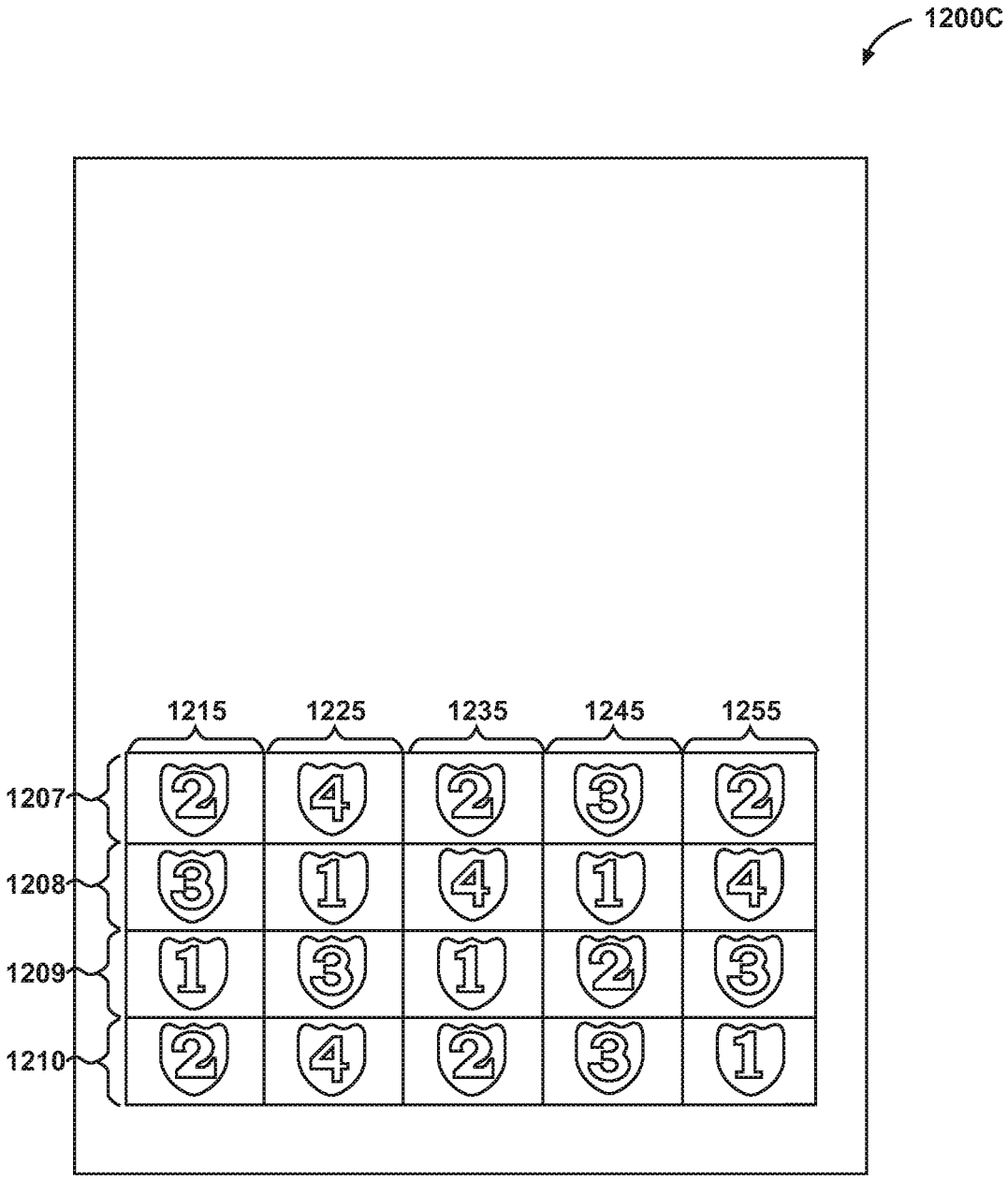

Turning now to FIGS. 11A-C, illustrated therein is a symbol array in which the plurality of symbol positions are arranged in a circular shape, with the symbol positions of the array forming successive layers around a center symbol position, the expansion thus resulting in a circle of an expanding diameter. As with the embodiments described herein regarding a symbol array having a rectangular shape, the symbol array of FIGS. 11A-11C can be expanded in response to a trigger event. In the example of FIG. 11, illustrating an example expansion mechanic of a circular shaped symbol array, the symbol array 1100A (FIG. 11A) progresses/expands to the symbol array 1100B (FIG. 11B) then further to the symbol array 1100C (FIG. 11C) by adding an outermost layer of symbol positions around an existing outermost layer of symbol positions forming the perimeter of the circle. Of course in other embodiments a circular shaped symbol array may be expanded by adding symbol positions in another manner (e.g., adding an additional symbol to one or more existing layers of the circle, thus expanding each layer rather than adding an additional layer of symbols). Turning now to FIGS. 12A-12C, illustrated therein is a symbol array as it is modified over a course of a plurality of game plays in accordance with embodiments in which a symbol array is contracted or decreased in size rather than expanded. As described earlier herein, in accordance with some embodiments a symbol array may be contracted or decreased in size in response to a trigger event (e.g., such as trigger event 400, described above with reference to FIGS. 3 and 4). In contracting a symbol array, symbol positions may be removed from the symbol array. The number of symbol positions removed may be determined in accordance with a random process (e.g., with the help of an RNG) or in accordance with one or more predetermined rules.

Any or all of the processes or methodologies described with reference to FIGS. 3, 4 and 5A-5B for expanding a symbol array may be applied in order to determine which symbol positions to remove in order to contract a symbol array. For example, the process 300 of FIG. 3 may be adapted to an embodiment in which a symbol array is contracted rather than expanded in response to a trigger event, such as by modifying step 306 to define or select a range of random symbol contraction possibilities of the symbol array or select the range of symbol array contraction from a predetermined number of symbol array contraction possibilities. The process described with respect to FIGS. 5A-5B may be similarly modified such that the special graphical representation 500 illustrates or wheel 501 may show, in each sector 502A, 502B and 502C an area of contraction range possibilities for symbol array 200, another symbol array or a previously contracted symbol array. Each area of contraction range possibility may indicate, for example, a plurality or set (or, in some embodiments, individual) symbol positions that are to be removed from the symbol array if the corresponding sector is selected via the random process.

It should be noted that although the term "remove" is utilized, in some embodiments removing a symbol position or plurality of symbol positions may comprise rendering them unavailable or unqualified towards determining any winning outcomes for a given game play. Thus, for example, a symbol position (or row, column or other set of symbol positions) may be grayed out, shaded or otherwise visually indicated as unavailable or unqualified for determining winning outcomes, such that any symbols that may appear in such symbol positions are not considered in determining whether a winning outcome has occurred along a given payline.

Returning again to FIGS. 12A-12C (collectively "FIG. 12"), illustrated therein is an example symbol array as it is modified in size over the course of a plurality of game plays, In the example of FIG. 12, illustrating an example contraction mechanic of a rectangular shaped symbol array, the symbol array 1200A (FIG. 12A) progresses/contracts to the symbol array 1200B (FIG. 12B) then contracts further to the symbol array 1200C (FIG. 12C) by removing a plurality of rows from the symbol array during each contraction, there being a respective symbol array contraction for each game play of the plurality of game plays. In the particular embodiment illustrated in FIG. 12, three (3) rows are removed during each contraction but in other embodiments a different number of rows may be removed. In some embodiments, it may not be rows that are removed but rather columns or random symbol positions within the matrix that together do not necessarily comprise a row or a column.

The symbol array 1200 (referred to as symbol array 1200A in the context of FIG. 12A, symbol array 1200B in the context of FIG. 12B and symbol array 1200C in the context of FIG. 12C) is comprised of (i) five (5) columns 1215, 1225, 1235, 1245 and 1255; and (ii) ten (10) rows 1201, 1202, 1203, 1204, 1205, 1205, 1207, 1208, 1209 and 1210. In the symbol array 1200A of FIG. 12A, all ten rows are shown. In the symbol array 1200B of FIG. 12B, the top three (3) rows 1201, 1202 and 1203 have been removed (e.g., in response to a trigger event). In the symbol array 1200C of FIG. 12C, the next three (3) rows from top-to-bottom, 1204, 1205 and 1206 have also been removed. In accordance with some embodiments, the number of rows (or the particular symbol positions, if in an arrangement other than rows) to be removed in response to a trigger event and the over subsequent game plays that follow the trigger event, are predetermined in accordance with rules of the game. In other embodiments, a range of the number of rows to be removed may be determined randomly (e.g., using a wheel or similar game mechanic, such as described with reference to FIGS. 5A and 5B) and then the particular number of rows within that range may be selected (e.g., randomly). In some embodiments, the rules of the game may dictate that a minimum number of rows (e.g., one (1)) remain for the last game play. In some embodiments, a special rule may be used to determine the range of rows to be removed for the last game play of the plurality of game plays awarded to the player as a result of the trigger event (e.g., to ensure that there is at least one (1) row remaining for the last game play). For example, in the particular embodiment of FIG. 12, the rule for the last game play may be that the range is set to follow the rule: (i) X=number of remaining rows; and (ii) maximum range=(X−1).

Although not illustrated in FIG. 12, in accordance with some embodiments in which a symbol array is contracted or reduced in size, an active area may also be determined after (or on conjunction with) the determination of which symbol positions (whether configures in rows or otherwise) are to be removed. An active area may be determined, for example, in a manner similar to that described with respect to FIGS. 6A-6D. For example, an active symbol array area that is less than or equal to the contracted symbol array area may be determined based on a random selection process. The active symbol array area may then be applied for the subsequent game play (e.g., only symbols within the active symbol array area may be included in a determination of whether any winning outcomes are included in the contracted symbol array).

In accordance with some embodiments, whether it be embodiments in which a symbol array is contracted or embodiments in which a symbol array is expanded, certain symbols in symbol positions remaining in the array (in embodiments in which the symbol array is contracted) or in symbol positions added to the symbol array (in embodiments in which the symbol array is expanded) may be replaced with each successive game play, based on one or more rules of the game or randomly. In the embodiment of FIG. 12, each symbol displayed in a symbol array (or available for display in the symbol array) corresponds to a different value (e.g., the values being based on a symbol hierarchy) and, as each row is removed, the current least valuable symbol (the symbol corresponding to the lowest relative value) is also removed. Any removed symbols may be replaced with other symbols that are determined randomly (e.g., with the help of the RNG) or in accordance with a rule of the game (e.g., with a symbol corresponding to the next highest value).

Turning now to FIG. 12A in particular, the symbol array 1200A comprises ten (10) rows and displays ten (10) different symbols, each symbol corresponding to a different value. In accordance with one example embodiment, the number of different symbols displayed in the symbol array (or available to be displayed in the symbol array) corresponds to the number of rows of the symbol array (this number being ten (10) in the example of FIG. 12A). It can further be assumed that a trigger event has been detected and that, in accordance with one example embodiment, the player is awarded three (3) successive game plays in a bonus feature of the game responsive thereto and that symbol array 1200A illustrates the particular symbol set output for the first of these three (3) game plays. In accordance with some embodiments, it may be assumed that the particular symbols and arrangement of the symbols in the particular symbol positions (each symbol position being identified by the row identifier and column identifier at which intersection it appears) of symbol array 1200A were determined in accordance with an RNG outcome.

In the example of FIG. 12A, it is determined that the range for the number of rows to be removed after the first game play (the outcome of which is illustrated in symbol array 1200A) is "up to four (4) rows" and that within this range it is determined (e.g., randomly) that three (3) rows are to be removed. These three (3) rows are indicated by reference numeral 1299A. Symbol array 1200B (FIG. 12B) illustrates the outcome of the second game play in the three game plays awarded to the player, in which the top three (3) rows 1201, 1202 and 1203 have been removed. It should also be noted that, as between the symbols illustrated in symbol array 1200A and the symbols illustrated in symbol array 1200B, some symbols have been replaced. As noted above, in some embodiments the symbols having the lowest value in each removed row (or symbols identified in accordance with some other rule of the game) are removed from the remaining rows and replaced with other symbols (e.g., which other symbols may be determined randomly). In the embodiment of FIG. 12A, it may be assumed that the symbols "9", "10" and "J" were the lowest value symbols that appeared in the removed rows ("10" having been positioned in the symbol position at the intersection of column 1215 and row 1202; "9" having been positioned in the symbol position at the intersection of column 1225 and row 1203 and "J" having been positions in the symbol position at the intersection of column 1245 and row 1203). Thus, in accordance with some embodiments, symbol array 1200B illustrates the set of symbols from symbol array 1200A but in which not only have the top three rows 1201, 1202 and 1203 been removed, but one in which all "9", "10" and "J" symbols have been replaced. Thus, the "10" of the symbol array 1200A that had appeared in the symbol position at the intersection of column 1215 and row 1205 has been replaced with a "K" in the symbol array 1200B, the "9" of the symbol array 1200A that had appeared in the symbol position at the intersection of column 1235 and row 1205 has been replaced with a "3" in the symbol array 1200B, the "J" of the symbol array 1200A that had appeared in the symbol position at the intersection of column 1225 and row 1207 has been replaced with a "K" and so on. The symbols in the symbol array 1200B may then be evaluated to determine whether a payout or other prize is due to the player as a result of any additional winning outcomes that may have been formed after the removal of the rows and replacement of symbols.

It is then determined that the range for the number of rows to be removed after the second game play (the outcome of which is illustrated in symbol array 1200B) is "up to three (3) rows" and that within this range it is determined (e.g., randomly) that all three (3) rows are to be removed. These three (3) rows are indicated by reference numeral 1299B. Symbol array 1200C (FIG. 12C) illustrates the outcome of the third game play in the three game plays awarded to the player, in which the next top three (3) rows 1204, 1205 and 1206 are removed (leaving the four (4) rows 1207, 1208, 1209 and 1210 as the remaining rows for the third and final game play). It should also be noted that, as between the symbols illustrated in symbol array 1200B and the symbols illustrated in symbol array 1200C, some symbols have been replaced. In the embodiment of FIGS. 12B-C. it may be assumed that the symbols "A", "K" and "Q" were the lowest value symbols that appeared in the removed rows ("K" having been positioned in the symbol position at the intersection of column 1215 and row 1205 as well as at the intersection of column 1235 and row 1206: "Q" having been positioned in the symbol position at the intersection of column 1225 and row 1205 as well as at the intersection of column 1245 and row 1205 and "A" having been positioned in the symbol position at the intersection of column 1225 and row 1206 as well as at the intersection of column 1255 and row 1206). Thus, in accordance with some embodiments, symbol array 1200C illustrates the set of symbols from symbol array 1200B but in which not only have the next top three rows 1204. 1205 and 1206 been removed, but one in which all "Q", "K" and "A" symbols have been replaced. Thus, the "Q" of the symbol array 1200B that had appeared in the symbol position at the intersection of column 1215 and row 1207 has been replaced with a "2" in the symbol array 1200C, the "K" of the symbol array 1200B that had appeared in the symbol position at the intersection of column 1225 and row 1207 has been replaced with a "4" in the symbol array 1200C, the ""A" of the symbol array 1200B that had appeared in the symbol position at the intersection of column 1245 and row 1207 has been replaced with a "3" and so on. The symbols in the symbol array 1200C may then be evaluated to determine whether a payout or other prize is due to the player as a result of any additional winning outcomes that may have been formed after the removal of the rows and replacement of symbols.

In accordance with some embodiments, the last game play of a plurality of game plays awarded to a player may be played in accordance with a special rule. For example, in some embodiments the last game play may be played such that there is only one (1) row remaining and with the symbol in each symbol position of the row corresponding to the highest value only, such that the player is guaranteed five-of-a-kind (assuming a five (5) column symbol array).

Although the symbol array illustrated in FIGS. 12A-12C is of a rectangular shape, as with embodiments in which a symbol array is expanded, a contracting symbol array may also comprise different shapes and the embodiments described herein are not dependent on any particular shape of a symbol array. FIGS. 13-17 illustrate various examples of additional symbol array shapes that may be utilized in embodiments in which a symbol array is contracted rather than expanded.

Figure 13A:
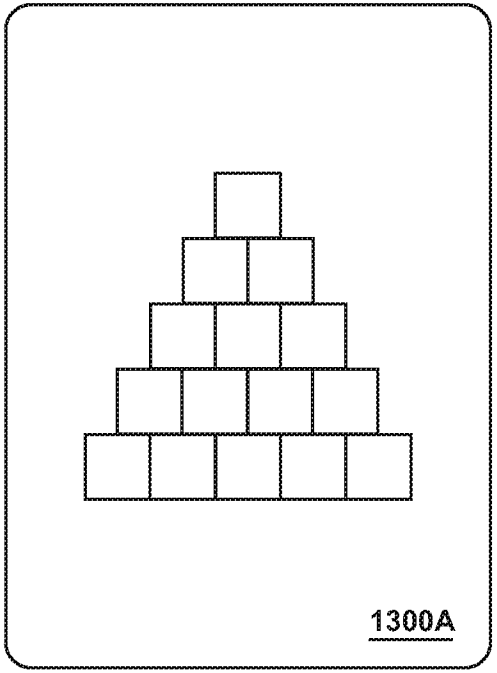
FIGS. 13A-C show illustrative screen shots of an alternative game play sequence showing a contraction process of the symbol array having a triangular shape.
Figure 13B:
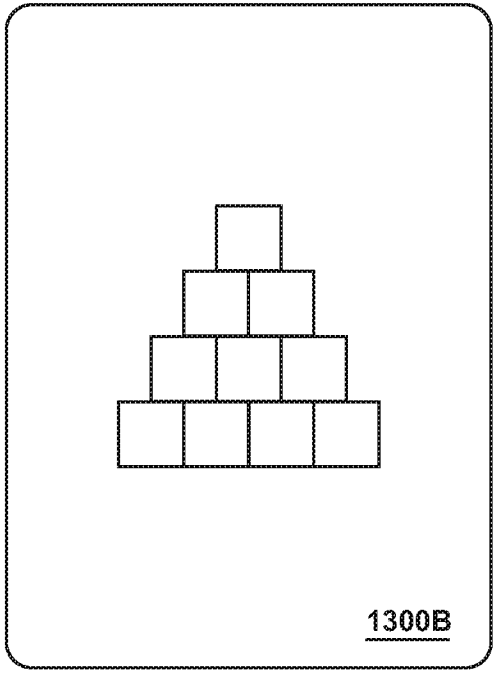
Figure 13C:
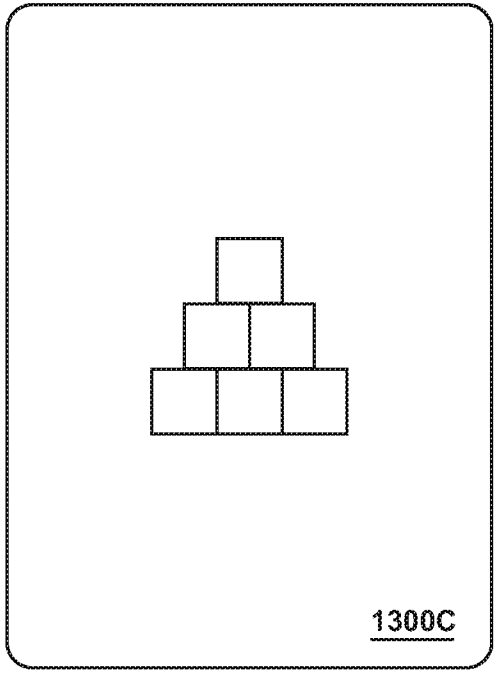

FIGS. 13A-13C show how a symbol array having a triangular shape may be contracted by progressively removing the bottom row from game play to game play. Thus, symbol array 1300B shows the bottom row of symbol array 1300A as having been removed and the symbol array 1300C shows the bottom row of symbol array 1300B as having been removed. The triangular shaped symbol array of FIGS. 13A-13C corresponds to that of FIGS. 7A-7C, but is shown as having symbol positions removed rather than added.

Figure 14C:
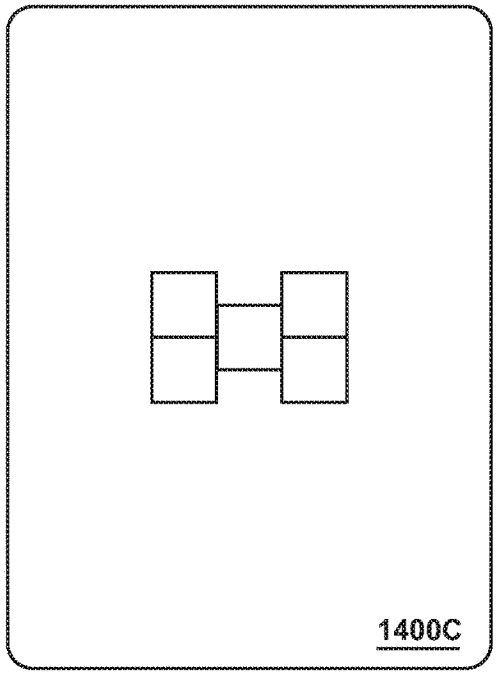
FIGS. 14A-C show illustrative screen shots of an alternative game play sequence showing a contraction process of the symbol array having a non-traditional or "ribbon" shape.
Figure 14B:
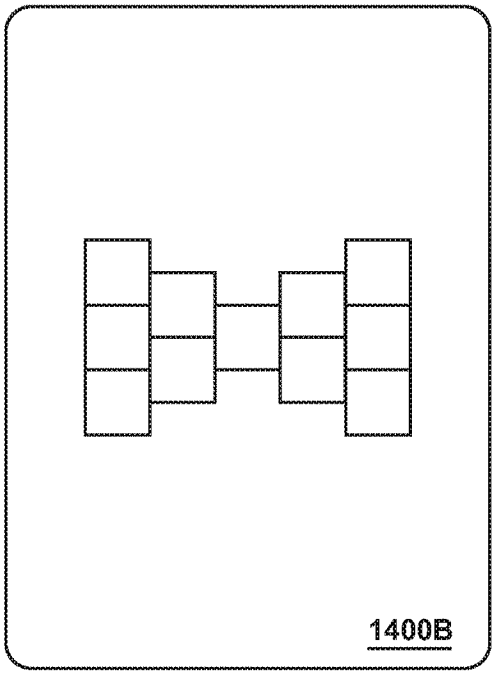
Figure 14A:
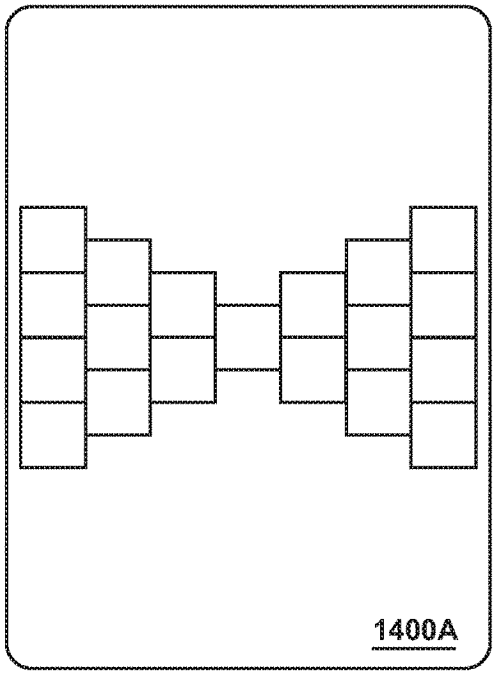

FIGS. 14A-14C show how a symbol array having a ribbon or bow shape may be contracted by progressively removing columns on either end of the shape. Thus, the symbol array 1400B shows each of the outermost columns of symbol array 1400A as having been removed and symbol array 1400C shows each of the outermost columns of symbol array 1400B as having been removed. The ribbon/bow shaped symbol array of FIGS. 14A-14C corresponds to that of FIGS. 8A-8C, but having symbol positions removed rather than added.

Figure 15A:
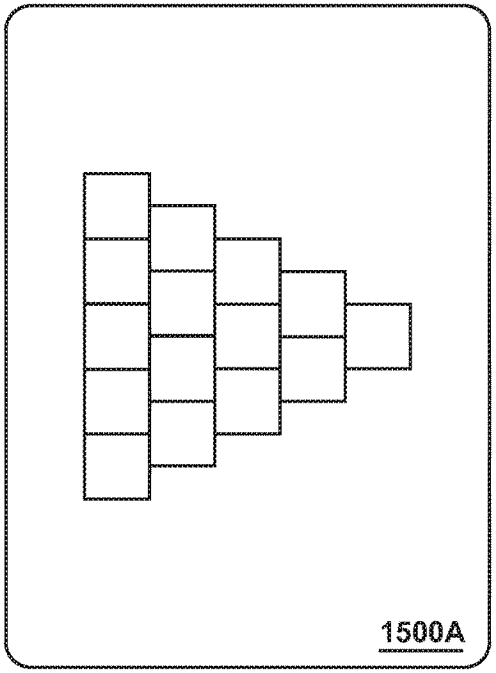
FIGS. 15A-C show illustrative screen shots of an alternative game play sequence showing a contraction process of the symbol array having a triangular shape positioned sideways.
Figure 15B:
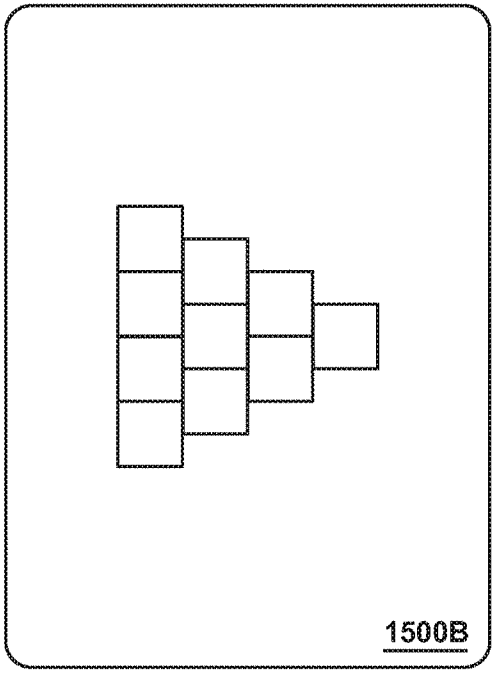
Figure 15C:
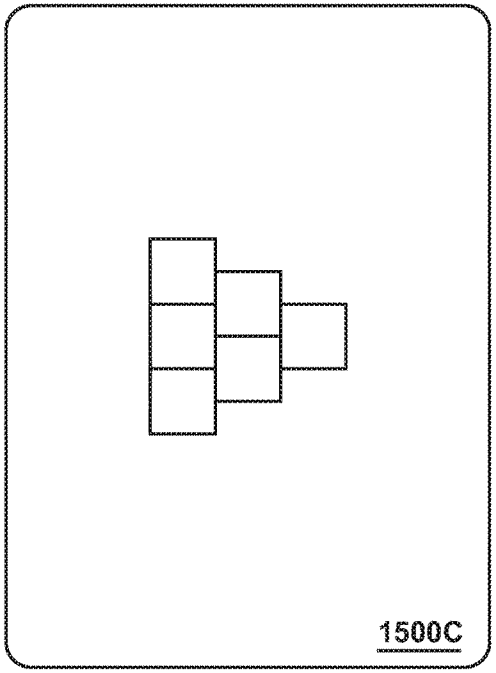

FIGS. 15A-15C show how a symbol array having a sideways triangle may be contacted by progressively removing the left-most column. Thus, symbol array 1500B shows the left-most column of symbol array 1500A as having been removed and symbol array 1500C shows the left-most column of symbol array 1500B as having been removed. The sideways triangle shaped symbol array of FIGS. 15A-15C corresponds to that of FIGS. 9A-9C, but having symbol positions removed rather than added.

Figure 16C:
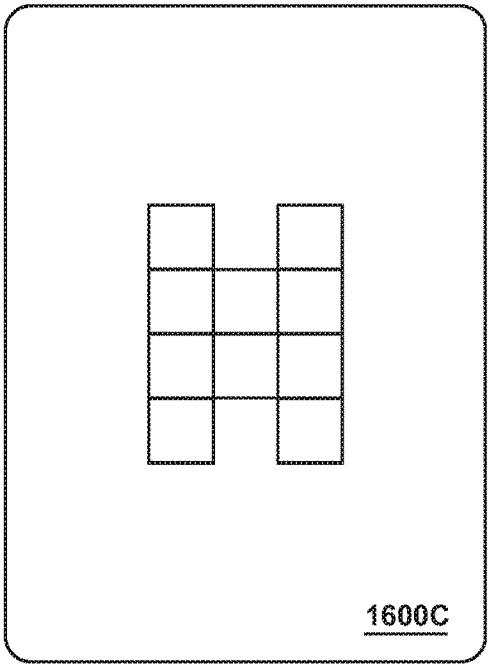
FIGS. 16A-C show illustrative screen shots of an alternative game play sequence showing a contraction process of the symbol array having an H-beam shape.
Figure 16B:
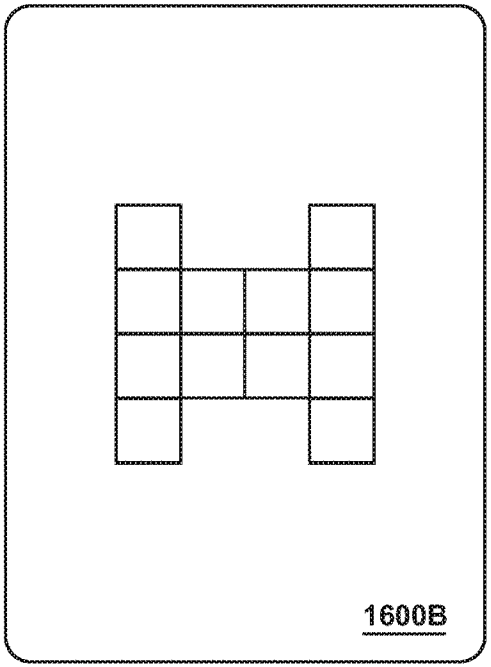
Figure 16A:
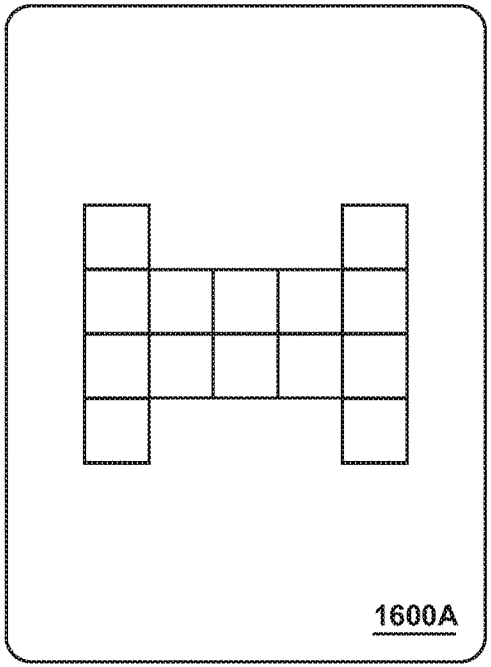

FIGS. 16A-16C show how a symbol array having an H-Beam shape may be contracted by progressively removing columns from the center section of the shape. Thus, symbol array 1600B shows one of the column in the center section of the H-Beam of symbol array 1600A as having been removed and symbol array 1600C shows one of the columns in the center section of the H-Beam of symbol array 1600B as having been removed. The H-Beam shaped symbol array of FIGS. 16A-16C corresponds to that of FIGS. 10A-10C, but having symbol positions removed rather than added.

Figure 17A:
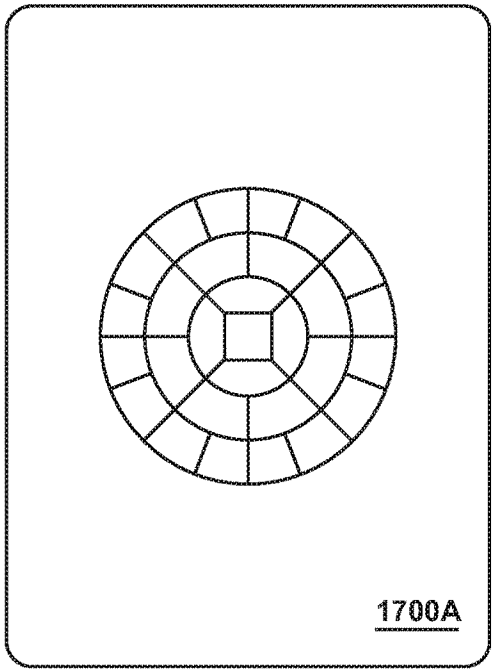
FIGS. 17A-C show illustrative screen shots of an alternative game play sequence showing a contraction process of the symbol array having a circular shape.
Figure 17B:
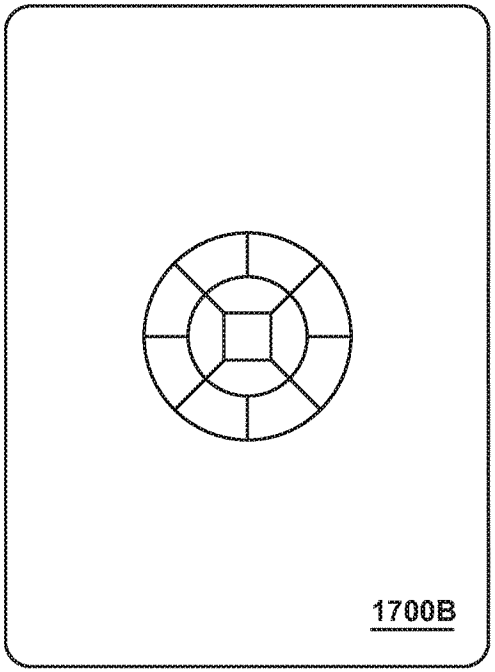
Figure 17C:
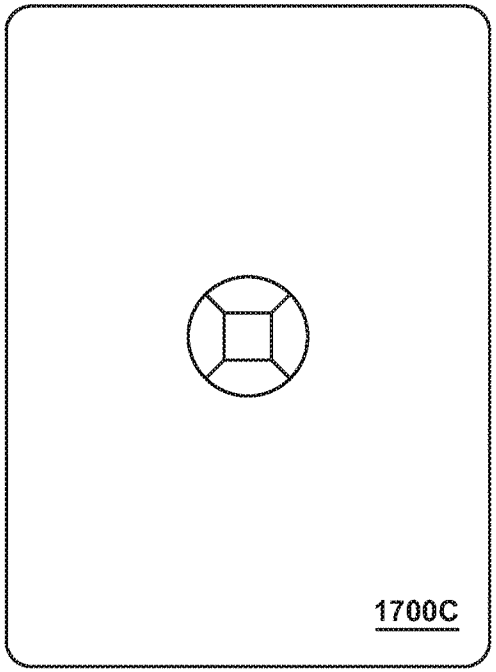

FIGS. 17A-17C show how a symbol array having a circular shape may be contracted by progressively removing an outermost layer of symbol positions from the shape. Thus, symbol array 1700B shows the outermost layer of symbol positions of symbol array 1700A as having been removed and symbol array 1700C shows the outermost layer of symbol positions of symbol array 1700B as having been removed. The H-Beam shaped symbol array of FIGS. 17A-17C corresponds to that of FIGS. 11A-11C, but having symbol positions removed rather than added.

While various example embodiments of the invention(s) have been described with respect to the figures, it will be appreciated that many modifications and changes may be made by those skilled in the art without departing from the spirit of the invention(s). For example, the game may be implemented as a free play game, in which it is not necessary to place a wager. In another example, still other symbol array shapes may be utilized (e.g., a non-symmetric shape utilizing honey-comb shaped symbol positions). Any variation and derivation from the above description and drawings are included in the scope of the present invention(s) as defined by the claims.

What is claimed is:

1. A gaming system via which a player plays a game, the game including a symbol array comprising a first number of symbol positions, the gaming system comprising:

a display device configured to display a sequence of game play with symbols arranged in the symbol array as game outcomes;

an input device configured to receive input from a player to initiate a game play;

a control unit in operative communication with the display device and the input device, and configured to control the game play to provide a plurality of symbols positioned in the symbol array, the control unit operable to:

initiate the game play in response to player input via the input device;

identify a trigger event during the game play;

determine, responsive to the trigger event, a defined range for varying a size of the symbol array for use in at least one subsequent game play;

generate a resized symbol array by varying the size of the symbol array in accordance with the range;

randomly determine an active symbol array area within the resized symbol array; and apply the resized symbol array and the active symbol array area for the at least one subsequent game play.

2. The system of claim 1, wherein the defined range for varying the size of the symbol array comprises a defined range for increasing the size of the symbol array by adding a second number of symbol positions to the first number of symbol positions, the second number being within the defined range;

and further wherein the control unit being operable to generate the resized symbol array comprises the control unit being operable to generate an expanded symbol array that comprises the symbol array plus the second number of symbol positions.

3. The system of claim 1, wherein the defined range for varying the size of the symbol array comprises a defined range for decreasing the size of the symbol array by removing from the first number of symbol positions a second number of symbol positions, the second number being within the defined range; and and further wherein the control unit being operable to generate the resized symbol array comprises the control unit being operable to generate a contracted symbol array that comprises the symbol array minus the second number of symbol positions.

4. The system of claim 1, wherein the control unit is further operable to display an indication of the defined range via the display device.

5. The system of claim 1, wherein the control unit is further operable to:

select a type of symbol array size variation to be applied for the at least one subsequent game play, the type being one of an expansion and a contraction of the symbol array.

6. The gaming system of claim 1, wherein the control unit being operable to determine the defined range for varying the size of the symbol array comprises the control unity being operable to:

identify the defined range for varying a size of the symbol array from a process previously performed during a previous game play, which process defined the range for varying the size of the symbol array to be used for at least one subsequent consecutive game play.

7. The gaming system of claim 6, wherein process previously performed during the previous game play is configured to define the range for varying the size of the symbol array based on a random selection process triggered by a trigger event that occurred during the previous game play.

8. The gaming system of claim 7, wherein the random selection process is configured to select a defined range for varying the size of the symbol array using equal or pre-weighted probability from a predefined number of possible defined ranges for varying the size of the symbol array.

9. The gaming system of claim 7, wherein the random selection process is configured to define the range for varying the size of the symbol array for at least one of (i) a plurality of consecutive game plays; (ii) a randomly defined number of bonus games or free games.

10. The gaming system of claim 1, wherein the control unit is further configured to indicate, on the display device, symbol positions comprising the defined range for varying the size of the symbol array.

11. The gaming system of claim 1, wherein the control unit is further configured to indicate, on the display device, symbol positions comprising the active symbol array area within the resized symbol array.

12. The gaming system of claim 1, wherein the control unit is further configured to indicate, on the display device, at least one of: (a) the determined active symbol array area; (b) possible active symbol areas; and (c) inactive areas of the resized symbol array.

13. The gaming system of claim 1, wherein the control unit is further configured to define the range for varying the size of the symbol array as removing one of: (a) at least one existing row of symbol positions of the symbol array; (b) at least one existing column of symbol positions of the symbol array; and (c) both (a) and (b).

14. The gaming system of claim 1, wherein the control unit is further configured to determine the active symbol array area from a plurality of available active symbol array areas using equal or pre-weighted probability.

15. The gaming system of claim 1, wherein the control unit being configured to generate the resized symbol array comprises the control unit being operable to generate a contracted symbol array that comprises the first number of symbol positions comprising the symbol array minus a second number of symbol positions;

and further wherein the control unit is further configured to replace, in the contracted symbol array, at least one symbol that had been carried over from the symbol array prior to the contracting.

16. The gaming system of claim 15, wherein the control unit is further configured to identify, based on a rule of the game, which at least one symbol is to be replaced in the contracted symbol array, thereby identifying at least one replaced symbol.

17. The gaming system of claim 16, wherein each symbol of the game corresponds to a different value and further wherein the rule of the game defines a replaced symbol as one that corresponds to the lowest value out of at least one of a row or column of the symbol array that had been removed to generate the contracted symbol array.

18. The gaming system of claim 16, wherein the control unit is further configured to identify, for each replaced symbol, a replacement symbol.

19. The gaming system of claim 18, wherein the replacement symbol is determined randomly from a set of the game symbols that does not include the at least one replaced symbol.

20. The gaming system of claim 1, wherein the symbol array, prior to the generating of the resized symbol array, comprises a predetermined number of rows and a predetermined number of columns.

21. The gaming system of claim 20, wherein the symbols array prior to the generating of the contracted symbol array comprise a number of different symbols, the number of different symbols being equal to the number of rows in the symbol array.

22. The gaming system of claim 1, wherein the control unit being operable to generate the resized symbol array comprises the control unit being operable to generate a contracted symbol array that comprises the symbol array minus the second number of symbol positions;

wherein the control unit is further operable to contract the symbol array successively over a plurality of consecutive game plays; and further wherein the control unit is operable to generate a contracted symbol array for a last of the plurality of consecutive game plays in accordance with a rule that ensures at least one row remains in the symbol array.

23. The gaming system of claim 1, wherein the control unit is operable to resize the symbol array successively over a plurality of consecutive game plays comprising a series of related game plays, the series of related game plays having been triggered upon the detection of the trigger event; and further wherein the control unit is operable to:

(a) resize the symbol array for a first game play of the series of related game plays by removing at least one symbol position from the symbol array as it is sized prior to the resizing, thereby generating a contracted symbol array for the first game play;

(b) resize the symbol array for a second game play of the series of related game plays by adding at least one symbol position to the symbol array as it is sized prior to the resizing, thereby generating an expanded symbol array for the second game play.

* * * * *